United States Patent [19]

Abel et al.

[11] 4,066,392

[45] Jan. 3, 1978

[54] PROCESS FOR MODIFYING KERATINOUS MATERIALS

[75] Inventors: Heinz Abel, Reinach; Rosemarie Topfl, Dornach, both of Switzerland

[73] Assignees: I.W.S. Nominee Company Limited, London, England; Ciba-Geigy AG, Basel, Switzerland

[21] Appl. No.: 613,649

[22] Filed: Sept. 15, 1975

Related U.S. Application Data

[63] Continuation of Ser. No. 480,083, June 17, 1974, abandoned.

[30] Foreign Application Priority Data

June 21, 1973 Switzerland ..... 9026/73

[51] Int. Cl.[2] ..... D06M 13/26; D06M 13/38; D06M 15/12; D06M 15/52

[52] U.S. Cl. ..... 8/127.5; 8/127.51; 8/127.6; 8/128 R; 8/128 A; 260/47 EP; 260/830 TW; 260/830 S; 428/270

[58] Field of Search ..... 8/127.51, 128 R, 128 A, 8/127.5, 127.6; 260/47 EP, 830 TW, 830 S; 428/270

[56] References Cited

U.S. PATENT DOCUMENTS

| | | | |
|---|---|---|---|
| 3,288,881 | 11/1966 | Lee | 260/830 TW |
| 3,645,781 | 2/1972 | Brown et al. | 117/141 |
| 3,703,352 | 11/1972 | Dobinson et al. | 8/128 A |
| 3,706,527 | 12/1972 | Dobinson et al. | 8/127.5 |
| 3,706,528 | 12/1972 | Dobinson et al. | 8/128 A |
| 3,813,220 | 5/1974 | Benisek et al. | 8/127.6 |

*Primary Examiner*—John Kight, III

*Attorney, Agent, or Firm*—Edward McC. Roberts; Prabodh I. Almaula

[57] ABSTRACT

A process for modifying keratinous material is provided, which comprises treating said material with organic solutions or aqueous emulsions which contain 1. polythiols with at least two thiol groups in the molecule and having a molecular weight of 400 to 20,000 and obtained from
   a. polyalcohols
   b. alkylene oxides and/or dicarboxylic acids and
   $c_1$. carboxylic acids containing thio groups, or from
   $c_2$. epihalohydrins and alkali hydrogen sulphides, the polythiols containing ether and/or ester bonds, or from
   $a_1$. polycarboxylic acids
   $b_1$. alkylene oxides or dialcohols and
   $c_1$. carboxylic acids containing thio groups,
2. nitrogen-containing condensation products of epoxides, fatty amines, dicarboxylic acids, the equivalent ratios of epoxide groups to hydrogen bound to amino nitrogen to carboxylic acid groups being 1:(0.1–1):(1–0.55), and, optionally, of aliphatic diols and/or aminoplast precondensates which contain alkyl ether groups and/or of epihalohydrins and, optionally,
3. stabilizers against the harmful action of light, and subsequently drying the treated material.

The stabilizers are preferably monomeric phenols with at least one sterically hindered hydroxyl group. The finished goods withstand washing in machines showing good shrink-resist effects and retain their original dimension and shape.

77 Claims, No Drawings

PROCESS FOR MODIFYING KERATINOUS MATERIALS

This is a continuation of application Ser. No. 480,083, filed on June 17, 1974, now abandoned.

The present invention provides a process for modifying keratinous material, and, in particular, a process for rendering the material resistant to shrinkage and a process for imparting durable press characteristics to the material.

A number of shrink-resist processes for keratinous material are known, some of which comprise the application of a resin to the material which may be in fabric form. Shrink-resist processes stabilize the dimensions of keratinous materials against shrinkage due to felting.

U.S. Pat. No. 3,645,781 describes a process for modifying keratinous material which comprises treating these materials with a compound containing at least 2 mercapto groups in the molecule and containing a. a radical of a polyhydric alcohol, b. bound to this radical, at least two poly(oxyalkylene) chains, c. bound through oxygen atoms to carbon atoms in the said poly(oxyalkylene) chains, at least two radicals selected from the group consisting of an acyl radical of a thiol containing aliphatic carboxylic acid and a radical, after removal of a hydroxyl group, of a thiol containing aliphatic alcohol, and fixing the mercapto compound on the keratinous material.

Another process is known from German Offenlegungsschrift 2.162.066. In this process, keratinous material is treated with a combination of the cited mercapto compounds and aliphatic polyamine-epichlorohydrin resins and subsequently cured. The treated material also exhibit non-felting and shrink-resist effects as well as durable press effects.

The present invention is based on the observation that it is possible to improve these non-felting and shrink-resist effects in unexpected manner by treating the keratinous material with the known mercapto compounds (polythiols) as well as nitrogen-containing condensation products of epoxides, fatty amines, dicarboxylic acids and, optionally, aliphatic diols and/or aminoplast precondensates which contain alkyl ether groups and/or epihalohydrins. Simultaneously the finished material can be rendered very stable against the damaging action of light, This stabilising of the material can optionally be reinforced by the addition of further suitable stabilisers. A further advantage is the rapid and complete curing of the polythiols on the fibres without imparting to the treated material an unattractive handle. Moreover, the finished material can be washed under the conditions for a full wash in domestic washing machines (IWS Specification 72), with any felting or shrinkage of the material remaining within the indicated limits. The present invention therefore provides a process for modifying keratinous material, which comprises treating this material with organic solutions or aqueous emulsions which contain 1. polythiols with at least 2 thiol groups in the molecule and having a molecular weight between 400 and 20,000 and obtained from
   a. polyalcohols,
   b. alkylene oxides and/or dicarboxylic acids and
   $c_1$. carboxylic acids containing thio groups or from
   $C_2$. epihalohydrins and alkali hydrogen sulphides, the polythiols containing ether and/or ester bonds, or from
   $a_1$. polycarboxylic acids,
   $b_1$. alkylene oxides or dialcohols and
   $c_1$. carboxylic acids containing thio groups,
2. nitrogen-containing condensation products of epoxides, fatty amines, dicarboxylic acids, in which the equivalent ratios of epoxide groups to hydrogen bonded to amino nitrogen to carboxy groups is 1: (0.1–1):(1–0.55), and optionally of aliphatic diols and/or aminoplast precondensates containing alkyl ether groups and/or of epihalohydrins and, optionally,
3. stabilisers against the harmful effects of light, and subsequently drying the treated material.

The polythiols contain at least 2 thiol groups in the molecule and they have a molecular weight between 400 and 20,000, preferably between 400 and 10,000. They contain in the molecule a. a radical of a polyhydric alcohol, b. bound to this radical, at least two poly(oxyalkylene) chains, c. bound though oxygen atoms to carbon atoms in the said poly(oxyalkylene) chains, at least two residues selected from the group consisting of an acyl residue of a thiol-containing aliphatic carboxylic acid or a residue, after removal of a hydroxyl group, of a thiol-containing aliphatic alcohol, or $a_1$. the acyl radical of a polycarboxylic acid, $b_1$. at least two oxyalkyl radicals bound to this radical, and $c_1$. at least two acyl radicals of carboxylic acids containing thio groups.

The thiol compounds to be used in the present process contain preferably from 3 to 6 thiol groups in the molecule. Particularly good results are obtained with compounds which contain 3 or 4 thiol groups.

Preferred polythiols are those having a molecular weight between 400 and 10,000, particularly those of formula $$\left[\ \right]_{R}\left[(-O-\text{alkylene})_m-OH\right]_{q-1}\left[(-O-\text{alkylene})_m-O(-CO)_{n-1}-X\right]_p \quad (1)$$

in which $m$ is an integer of at least 1 and may have different values in each of the $p$ and $(q-1)$ chains, $n$ is 1 or 2, $p$ is at least 2, $(p+q)$ equals at least 3 and at most 7, each alkylene group contains a chain of at least 2 and at most 6 carbon atoms between consecutive oxygen atoms, R represents an aliphatic radical containing at least 2 carbon atoms, and X represents an aliphatic radical with 1 to 18 carbon atoms and containing at least one thiol group.

The oxyalkylene units in individual poly(oxyalkylene) chains may be substituted, if desired, by e.g., phenyl or chloromethyl groups.

There may thus be used compounds of the formula $$\left[\mathrm{R}\right]\left[(-\mathrm{O}-\text{alkylene})_{\overline{m}}-\mathrm{OH}\right]_{q-1}\left[(-\mathrm{O}-\text{alkylene})_{\overline{m}}-\mathrm{O}-\mathrm{CO}-\mathrm{C}_u\mathrm{H}_{2u}-\mathrm{SH}\right]_p$$

in which R, alkylene, *m, p,* and *q* have the meanings previously assigned, and *u* is a positive integer of 1 or 2.

Further preferred are esters of the formula $$\left[\mathrm{R}_1\right]\left[(-\mathrm{O}-\text{alkylene})_{\overline{m}}-\mathrm{OH}\right]_{q-1}\left[(-\mathrm{O}-\text{alkylene})_{\overline{m}}-\mathrm{O}-\mathrm{CO}-\mathrm{C}_u\mathrm{H}_{2u}-\mathrm{SH}\right]_{P_1}$$

in which alkylene, *m, Q* and *u* have the meanings previously assigned, $P_1$ is an integer of 2 to 6,
and $R_1$ represents an aliphatic radical having at least 2 and at most 6 carbon atoms.

Yet further preferred are esters of formula $$\left[\mathrm{R}_2\right]\left[(-\mathrm{O}-\text{alkylene}-)_m-\mathrm{O}-\mathrm{CO}-\mathrm{C}_u\mathrm{H}_{2u}-\mathrm{SH}\right]_{P_2}, \tag{4}$$

in which alkylene, *m* and *u* have the meanings previously assigned, $P_2$ is an integer of 3 to 6,
and $R_2$ represents an aliphatic hydrocarbon radical having at least 3 and at most 6 carbon atoms.

Still further preferred are esters based on glycerol, hexane-1,2,5-triol, or hexane-1,2,6-triol, and ethylene oxide and/or propylene oxide, i.e. those of the formulae $$\begin{array}{l}\mathrm{CH_2}-(\mathrm{OC}_t\mathrm{H}_{2t})_{\overline{m}}-\mathrm{O}-\mathrm{CO}-\mathrm{C}_u\mathrm{H}_{2u}-\mathrm{SH}\\ |\\ \mathrm{CH}-(\mathrm{OC}_t\mathrm{H}_{2t})_{\overline{m}}-\mathrm{O}-\mathrm{CO}-\mathrm{C}_u\mathrm{H}_{2u}-\mathrm{SH}\\ |\\ \mathrm{CH_2}-(\mathrm{OC}_t\mathrm{H}_{2t})_{\overline{m}}-\mathrm{O}-\mathrm{CO}-\mathrm{C}_u\mathrm{H}_{2u}-\mathrm{SH}\end{array} \tag{5}$$

and $$\begin{array}{l}\mathrm{CH_2}-(\mathrm{OC}_t\mathrm{H}_{2t})_{\overline{m}}-\mathrm{O}-\mathrm{CO}-\mathrm{C}_u\mathrm{H}_{2u}-\mathrm{SH}\\ |\\ \mathrm{CH}-(\mathrm{OC}_t\mathrm{H}_{2t})_{\overline{m}}-\mathrm{O}-\mathrm{CO}-\mathrm{C}_u\mathrm{H}_{2u}-\mathrm{SH}\\ |\\ \mathrm{CH_2}\\ |\\ \mathrm{CH_2}\\ |\\ \left[\begin{array}{l}\mathrm{CH}-\\ |\\ \mathrm{CH_2}-\end{array}\right]\begin{array}{l}[-\mathrm{H}]\\ [-(\mathrm{OC}_t\mathrm{H}_{2t})_{\overline{m}}-\mathrm{O}-\mathrm{CO}-\mathrm{C}_u\mathrm{H}_{2u}-\mathrm{SH}\ ].\end{array}\end{array} \tag{6}$$

in which *m* and *u* have the meanings previously assigned, and *t* is an integer of at least 2 and at most 3.

These mercaptan-terminated poly(alkylene oxide) esters are readily prepared by the reaction of a polyhydric alcohol with an alkylene oxide followed by esterification of the hydroxyl groups of the adduct with a mercaptancarboxylic acid.

Suitable polyhydric alcohols include ethylene glycol, poly(oxyethylene) glycols, propylene glycol, poly (pxypropylene) glycols, propane-1,3-diol, poly(epichlorohydrins), butane-1,2-, -1,3-, -1,4-, and-2,3-diol, poly (tetrahydrofurans), glycerol, 1,1,1-trimethylol-ethane and-propane, hexane-1,2,5- and -1,2,6-triol, 3-hydroxymethylpentane-2,4-diol, pentaerythritol, dipentaerythritol, mannitol, sorbitol, and adducts of alkylene oxides with the aforementioned polyols, ammonia, or amines such as diethanolamine and tetrakis(2-hydroxyethyl)ethylenediamine. Suitable alkylene oxides include ethylene oxide, propylene oxide, and, less preferably, the butylene oxides, epichlorohydrin, and tetrahydrofuran. If desired, the polyhydric alcohol may be treated with one alkylene oxide, say, propylene oxide, and then "tipped" with a different alkylene oxide, such as ethylene oxide. The preferred mercaptancarboxylic acids for the esterification are thioglycollic acid and 2- and 3-mercaptopropionic acid.

However, it is also possible to use other mercaptocarboxylic acids e.g. mercaptoundecanoic acid and mercaptostearic acid.

Polythiol esters most preferred for the purpose of the present invention are those obtained from glycerol, propylene oxide, and thioglycollic acid, i.e. of formula $$\begin{array}{l}\mathrm{CH_2}(-\mathrm{O}-\mathrm{C_3H_6})_{\overline{m}}-\mathrm{O}-\mathrm{CO}-\mathrm{CH_2}-\mathrm{SH}\\ |\\ \mathrm{CH}(-\mathrm{O}-\mathrm{C_3H_6})_{\overline{m}}-\mathrm{O}-\mathrm{CO}-\mathrm{CH_2}-\mathrm{SH}\\ |\\ \mathrm{CH_2}(-\mathrm{O}-\mathrm{C_3H_6})_{\overline{m}}-\mathrm{O}-\mathrm{CO}-\mathrm{CH_2}-\mathrm{SH}\end{array} \tag{7}$$

where *m* has the meaning previously assigned, having a molecular weight within the range 1000 to 5000. Such compounds are known.

As is evident from the general definition, it is possible to use in the present process not only mercapto esters, but also mercapto ethers for example those of formula $$\left[\mathrm{R}\right]\left[-(\text{O-alkylene})_{\overline{m}}-\mathrm{OH}\right]_{q-1}\left[-(\text{O-alkylene})_{\overline{m}}-\mathrm{O}-\mathrm{CH_2}-\underset{\mathrm{R_3}}{\underset{|}{\mathrm{CH}}}-\mathrm{CH_2}-\mathrm{SH}\right]_p \tag{8}$$

in which $R_3$ denotes —OH, —(O-alkylene)$_v$OH, —O.CO.$C_uH_{2u}$SH, or —(O-alkylene)$_v$O.CO.$C_uH_{2u}$SH, R, alkylene, *m, p, q* and *u* have the meanings previously assigned, and *v* is an integer of at least 1 and may have different values in each of the *p* chains.

The oxyalkylene units in the individual poly(oxyalkylene) chains may likewise be different, but are preferably the same, and may be substituted if desired by e.g., phenyl or chloromethyl groups.

Preferred among such ethers are those which are of the formula $$\left[\mathrm{R}_1\right]\left[(-\mathrm{O}-\text{alkylene})_m-\mathrm{OH}\right]_{q-1}\left[(-\mathrm{O}-\text{alkylene})_m-\mathrm{O}-\mathrm{CH_2}-\underset{\mathrm{R_3}}{\underset{|}{\mathrm{CH}}}-\mathrm{CH_2}-\mathrm{SH}\right]_{P_1} \tag{9}$$

in which alkylene, $R_1$, *m*, $R_3$, $P_1$ and *q* have the meanings previously assigned, and further preferred are those of the formula $$\left[\mathrm{R}_2\right]\left[(-\mathrm{O}-\text{alkylene})_m-\mathrm{O}-\mathrm{CH_2}-\underset{\mathrm{R_3}}{\underset{|}{\mathrm{CH}}}-\mathrm{CH_2}-\mathrm{SH}\right]_{P_2}, \tag{10}$$

in which $R_2$ and $P_2$ also have the meanings previously assigned.

The particularly preferred ethers are those of formula $$\left[R_2\right]\left[(-O-C_tH_{2t})_m-O-CH_2-\underset{\underset{OH}{|}}{CH}-CH_2-SH\right]_{p_2}, \quad (11)$$

in which $R_2$, $t$, $m$ and $p_2$ have the meanings previously assigned.

The ethers of formula (8) may be prepared in a known manner. Those in which $R_3$ denotes —OH may be prepared by addition of an alkylene oxide to a polyhydric alcohol, etherification of the hydroxyl groups of the adduct with epichlorohydrin, and treatment with sodium hydrosulphide to replace the chlorine by a sulphhydryl group (see U.S. Pat. No. 3,258,495, and United Kingdom Specifications 1,076,725 and 1,144,761). In many cases the average number of thiol groups per molecule is not an integer but, for example, may be 2.6. This is attributable partly to the replacement of the chlorine atom by the —SH group not going to completion, and partly to side-reactions: for example, the chlorohydrin ether obtained by reaction with epichlorohydrin may react again with epichlorohydrin, so forming an ether which contains two replaceable chlorine atoms per hydroxyl group originally present in the polyhydric alcohol.

Ethers of formula $$\left[R_2\right]\left[(-O-C_tH_{2t})_m-O-CH_2-\underset{\underset{OCOCH_2SH}{|}}{CH}-CH_2-SH\right]_{p_2}, \quad (12)$$

in which $R_2$, $t$, $m$, $v$ and $p_2$ have the meanings previously assigned, are likewise particularly preferred.

Ethers of formula (8) in which $R_3$ denotes —(O-alkylene)$_v$OH may be prepared by treating the product which is obtained from epichlorohydrin, the alkylene oxide and the polyhydric alcohol, first with an alkylene oxide, and then with sodium hydrosulphide (see United Kingdom Specification 1,144,761).

The most preferred ethers are those of formula $$\begin{array}{l} CH_2-(O-C_3H_6)_m-O-CH_2-\underset{\underset{OH}{|}}{CH}-CH_2-SH \\ | \\ CH-(O-C_3H_6)_m-O-CH_2-\underset{\underset{OH}{|}}{CH}-CH_2-SH, \\ | \\ CH_2-(O-C_3H_6)_m-O-CH_2-\underset{\underset{OH}{|}}{CH}-CH_2-SH \end{array} \quad (13)$$

(in which formula the values $m$ of the individual chains can be different) having a molecular weight within the range 700 to 3500.

or of the formula $$\begin{array}{l} CH_2-(OC_3H_6)_mOCH_2\underset{\underset{OCOCH_2SH}{|}}{CH}CH_2SH \\ | \\ CH-(OC_3H_6)_mOCH_2\underset{\underset{OCOCH_2SH}{|}}{CH}CH_2SH \\ | \\ CH_2-(OC_3H_6)_mOCH_2\underset{\underset{OCOCH_2SH}{|}}{CH}CH_2SH \end{array} \quad (14)$$

The ether-esters of formula (8) in which $R_3$ denotes —O.CO.$C_uH_{2u}$SH or —(O-alkylene)$_v$O.CO.$C_uH_{2u}$SH are obtainable by esterification of the corresponding alcohol with a mercaptocarboxylic acid $$HOOCC_uH_{2u}SH \quad (15)$$

The second main class of preferred polymercaptans comprise polyesters of the average formula $$W\left((O)_rCO(O)_qZ(O)_qCO(O)_rYSH\right)_p \quad (16)$$

wherein $q$ and $r$ are zero or 1 but are not the same, $p$ is a positive integer of at most 6, Z represents a divalent organic radical, linked through a carbon atom or carbon atoms thereof to the indicated —O— or —CO— units, Y represents a divalent organic radical, linked through a carbon atom or carbon atoms thereof to the indicated -SH group and —O— or —CO— units, and W represents an organic radical which must contain at least one —SH group when $p$ is 1, linked through a carbon atom or carbon atoms thereof to the indicated —O— or —CO— units.

More specifically, the average structures of the preferred esters can be represented by one of the formulae $$R^{13}-[O-CO-R^{11}-CO-O-R^{15}SH]_s \quad (17)$$
$$R^{13}-[CO-O-R^{12}O-CO-R^{16}SH]_s \quad (18)$$
$$R^{13}-[O-[CO-R^{11}-CO-O-R^{12}-O]_r-CO-R^{16}SH]_s \quad (19)$$
$$R^{13}-[CO-[O-R^{12}-O-CO-R^{11}CO]_r-O-R^{15}SH]_s \quad (20)$$
$$R^{13}-[O-[CO-R^{11}-CO-O-R^{12}-O]_r-CO-R^{11}COO-R^{15}SH]_s \quad (21)$$
$$R^{13}-[CO-[O-R^{12}-O-CO-R^{11}-CO]_r-O-R^{12}OCO-R^{16}SH]_s \quad (22)$$
$$H-[O-R^{12}-O-CO-R^{14}-CO]_s-OR^{12}OH \quad (23)$$
$$HSR^{16}-CO-O-R^{12}-O-[COR^{14}COOR^{12}O]_r-COR^{16}SH \quad (24)$$

and especially by one of the formulae $$R^{13}-[OCO-R^{11}-CO-O-C_mH_{2m}SH]_s \quad (25)$$
$$R^{13}-[CO-O-R^{12}-O-CO-C_jH_{2j}SH]_s \quad (26)$$
$$R^{13}-[O-[CO-R^{11}-CO-O-R^{12}-O]_r-CO-C_jH_{2j}SH]_s \quad (27)$$
$$R^{13}-[O-[CO-R^{11}-CO-O-R^{12}-O]_r-CO-R^{11}COOC_mH_{2m}SH]_s \quad (28)$$
$$R^{13}-[CO-[O-R^{12}-O-CO-R^{11}-CO]_r-OC_mH_{2m}SH]_s \quad (29)$$
$$R^{13}-[CO-[O-R^{12}-O-CO-R^{11}-CO]_r-O-R^{12}-O-CO-C_jH_{2j}SH]_s \quad (30)$$
$$H-\left[O-R^{12}-O-CO-CH_2\underset{\underset{SH}{|}}{CH}CO\right]_s-OR^{12}OH \quad (31)$$

-continued $$HS-C_jH_{2j}-CO-O-R^{12}-O\left[CO-CH_2\underset{\underset{SH}{|}}{C}HCO-O-R^{12}O\right]_t-CO-C_jH_{2j}SH \quad (32)$$

wherein $j$ is 1 or 2 and $m$ is 2 or 3, $R^{11}$ denotes the residue of an aliphatic, cycloaliphatic, or aromatic dicarboxylic acid after removal of the two —COOH groups, $R^{12}$ denotes the residue of an aliphatic, araliphatic, or cycloaliphatic diol after removal of the two hydroxyl groups, $R^{13}$ denotes an organic radical containing at least two carbon atoms and directly linked through carbon atoms thereof to the indicated mercaptan terminated ester chains, $R^{14}$ denotes the residue of an aliphatic, cycloaliphatic or aromatic dicarboxylic acid containing a mercaptan group, after removal of the —COOH groups, $t$ is an integer of at least 1, $s$ is an integer of at least 2, $R^{15}SH$ denotes the residue of a monomercaptanmonohydric alcohol after the removal of an alcoholic hydroxyl group, and $R^{16}SH$ denotes the residue of a monomercaptanmonocarboxylic acid after the removal of a carboxyl group.

Preferably $R^{11}$ denotes (a) a saturated aliphatic hydrocarbon group of 2 to 10 carbon atoms, which may bear an —SH group, (b) a cycloaliphatic-aliphatic hydrocarbon group of 5 to 34 carbon atoms, which may contain ethylenic unsaturation, or (c) a monomuclear arylene hydrocarbon group of 6 to 12 carbon atoms.

$R^{12}$ may denote a saturated aliphatic hydrocarbon chain of 2 to 250 carbon atoms, which may be substituted by methyl groups and by —SH groups, and which may be interrupted by ether oxygen atoms and by carbonyloxy groups.

$R^{13}$ may denote, when directly attached to an —O— unit, a saturated aliphatic hydrocarbon chain of 2 to 250 carbon atoms, which may be substituted by methyl groups and by —SH groups and which may be interrupted by ether oxygen atoms and by carbonyloxy groups, and, when directly attached to a —CO— unit, (a) a saturated aliphatic hydrocarbon group of 2 to 10 carbon atoms, which may bear an —SH group, (b) a cycloaliphatic-aliphatic hydrocarbon group of 5 to 51 carbon atoms, which may contain ethylenic unsaturation, or (c) a monomuclear arylene hydrocarbon group of 6 to 12 carbon atoms.

It will be understood that formulae (17) to (32) represent the average structure of the esters. Because of incomplete esterification, other radicals may also be present.

The polyesters may be obtained by the reaction, in any desired sequence of, a'. a monomercaptanmonocarboxylic acid or a monomercaptanmonohydric alcohol, b'. a compound containing two, alcoholic hydroxyl groups, and c'. a compound containing at least three carboxylic acid groups.

If desired, components (b') and (c') may be reacted to form a hydroxyl- or carboxyl-terminated ester which is then esterified with (a').

Such esters may also be those obtainable by the esterification of d'. a monomercaptandicarboxylic acid with e'. a compound containing two to six alcoholic hydroxyl groups, and, optionally, f'. a dicarboxylic acid containing no mercaptan group, or an anhydride of such an acid, or g'. a monocarboxylic acid, preferably a monomercaptanmonocarboxylic acid, or h'. a monohydric alcohol, preferably a monomercaptanmonohydric alcohol.

Similarly there may be employed esters obtainable by the reaction, in any desired sequence, of a'. a monomercaptanmonocarboxylic acid or a monomercaptanmonohydric alcohol, i'. a compound containing at least three alcoholic hydroxyl groups per molecule and j'. a compound containing two, carboxylic acid groups per molecule.

As those skilled in the art of making polyesters will appreciate, a carboxylic anhydride may be used in place of the corresponding carboxylic acid while a 1,2-epoxide may be substituted for an alcohol, one epoxide group corresponding to one primary and one secondary alcoholic hydroxyl group.

Substances containing at least two carboxylic acid groups, or anhydrides thereof, which may be used at component (c'), (f'), or (j') include succinic, adipic, phthalic, hexahydrophthalic, sebacic, malic, citric, tricarballylic, and pyromellitic acid and dimerised and trimerised ethylenically-unsaturated fatty acids, and their anhydrides (where existing). Although they can be used, ethylenically-unsaturated dicarboxylic acids are not preferred.

Monomercaptanmonocarboxylic acids used as component (a') are preferably thioglycollic and 2- and 3-mercaptopropionic acids.

Monomercaptanmonohydric alcohols used as component (a') are preferably 2-mercaptoethanol, 1-mercaptopropan-2-ol, and 2-mercaptopropan-1-ol.

The monomercaptandicarboxylic acid (d') is preferably mercaptosuccinic acid, ($HOOCCH_2CH(SH)COOH$).

The substances containing at least two alcoholic hydroxyl groups (b', e', i') include those already listed above as suitable polyhydric alcohols for making the compounds of formula 2 to 6.

Mono-1,2-epoxides which may be used in place of a dihydric alcohol include those listed above and also glycidyl ethers of alcohols or of phenols, N-glycidyl compounds, and glycidyl esters of carboxylic acids.

In place of trihydric and higher alcohols there may be used monoepoxymonohydric alcohols such as glycidol, or a diepoxide such as a diglycidyl ether of an alcohol or a phenol.

It is often desirable, when preparing a polymercaptan ester for use in the present invention, to incorporate a monofunctional compound such as a monocarboxylic acid (g') or a monohydric alcohol (h') as a chain-terminator, and it is especially advantageous to use a compound containing a mercaptan group, examples being monomercaptanmonocarboxylic acids and monomercaptanmonohydric alcohols and, more specifically, thioglycollic acid, 2-mercaptopropionic acid, 2-mercaptoethanol, and 2-mercaptopropan-1-ol.

The polymercaptan esters are, in general, known substances (see U.S. Pat. Nos. 2,456,314, 2,461,920, 2,914,585 and 3,138,573, French Patent Specification No. 1,503,633 and British Patent Specification No.

941,829). They can be prepared by heating the reactants in the presence of a catalyst such as a strong acid (especially an anion exchange resin, toluene-p-sulphonic acid, or 50% sulphuric acid) and of an inert solvent, such as toluene, xylene, trichloroethylene, or perchloroethylene, with which water formed in the reaction can be removed as an azeotrope.

The nitrogen-containing condensation products (2) are obtained from d. epoxides
e. fatty amines
f. dicarboxylic acids and optionally
g. aliphatic diols
h. aminoplast precondensates containing alkyl ether groups and
i. polyfunctional, preferably difunctional, organic compounds.

The epoxides d) contain at least 2 epoxide groups in the molecule and are preferably derived from polyhydric phenols or polyphenols, such as resorcinol, or phenolformaldehyde condensation products of the type of the resols or novolaks. Bisphenols, such as bis-(4-hydroxyphenyl)-methane and above all 2,2-bis-(4'-hydroxyphenyl)-propane, are especially preferred as starting compounds for the manufacture of the epoxides.

Compounds to be mentioned especially are epoxides of 2,2-bis-(4'-hydroxyphenyl)-propane which have an epoxide content of 1.8 to 5.8 epoxy group equivalent/kg, but preferably at least 5 epoxy group equivalent/kg, and which correspond to the formula

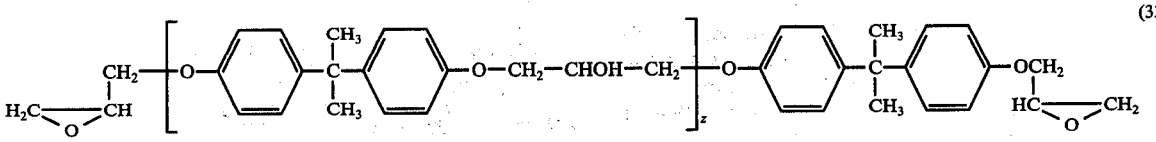

(33)

wherein $z$ denotes a mean number having a value of 0 to 0.65. Such epoxides are obtained by reaction of epichlorohydrin with 2,2-bis-(4'-hydroxyphenyl)-propane.

Mono-fatty amines with 12 to 24 carbon atoms have above all proved to be very suitable components (e). As a rule, these are amines of the formula $$H_3C - (CH_2)_x - NH_2 \quad (34)$$

wherein $x$ represents an integer having a value of 11 to 23, preferably 17 to 21. These amines are, for example, laurylamine, myristyle, palmitylamine, stearylamine, arachidylamine or behenylamine. Mixtures of such amines, such as are obtainable a commercial products, can also be used.

Alkylenedicarboxylic acids with 7 to 14 carbon atoms have above all proved advantageous components (f). As a rule, these are dicarboxylic acids of the formula $$HOOC - (CH_2)_y - COOH \quad (35)$$

wherein $y$ denotes an integer from 5 to 12, preferably 6 to 10.

Examples of components (f) are pimelic, suberic, azelaic or sebacic acid, nonanedicarboxylic acid, decanedicarboxylic acid, undecanedicarboxylic acid or dodecanedicarboxylic acid.

Where the diols (g) are conjointly used for the manufacture of the reaction products, these diols are preferably aliphatic diols with 2 to 22 preferably 2 to 6 carbon atoms, the carbon chains of which are optionally interrupted by oxygen atoms. Alkylenediols with 2 to 6 carbon atoms or diethylene glycol or triethylene glycol are here of particular interest. Examples of the alkylenediols with 2 to 6 carbon atoms which are used with particular advantage include ethylene glycol, 1,4-butanediol, 1,6-hexanediol or preferably neopentylglycol.

Where the component (h) is used conjointly for the manufacture of the reaction products, the amount of it relative to the total of the components (d), (e), (f) and (h), is 10 to 50, especially 20 to 25, percent by weight.

The aminoplast condensates used as component (h) are completely etherified, or especially partially etherified, methylol compounds of nitrogen-containing aminoplast-forming agents, such as urea, urea derivatives, for example ethylene urea, propylene urea or glyoxal monourein.

Preferably, however, etherfied methylolaminotriazines are employed, such as alkyl ethers of highly methylolated melamine the alkyl radicals of which contain 1 to 4 carbon atoms. Possible alkyl radicals include methyl, ethyl, n-propyl, isopropyl, n-butyl and n-hexyl radicals, In addition to such alkyl radicals, still further radicals, for example polyglycol radicals, can also be present in the molecule. Furthermore, n-butyl ethers of a highly methylolated melamine, which contain 2 to 3 n-butyl groups in the molecule, are preferred. Highly methylolated melamines are to be understood herein as meaning those with an average of at least 5, desirably about 5.5, methylol groups.

The optionaly, polyfunctional, preferably difunctional, component (i) preferably contains, as functional groups or atoms, alkyl-bonded halogen atoms, vinyl or carboxylic acid ester groups, or at most one epoxide, carboxylic acid or hydroxyl group together with another functional group or another atom of the indicated type.

Particularly suitable difunctional organic compounds are aliphatic compounds. These are, for example, epihalohydrins, such as epibromohydrin or above all epichlorohydrin.

Other possibel difunctional compounds are, for example, glycerol-dichlorohydrin, acrylic acid, methylolacrylamide and acrylonitrile.

The manufacture of the reaction products can be carried out according to methods which are in themselves known, wherein the components can be reacted with one another in varying sequence. Appropriately, components (d) and (e), or (d), (e) and (f) are first reacted with one another. The reaction of the component (f) with the already reacted components (d) and (e) can also take place simultaneously with component (e). The reaction of the components (h) and (i) is as a rule only carried out at the end.

On the one hand it is therefore possible initially to react the components (d), (e) and (f), simultaneously with one another, and then optionally to react the product with the components (g), (h) and (i). In this process modification the components (d), (e) and (f) are appropriately reacted with one another at temperatures of 80° to 120° C, preferably at 100° C, and the proportions are advantageously so chosen that, for an epoxide group equivalent of 1, the equivalent ratio of hydrogen bonded to amine nitrogen to carboxylic acid groups is (0.1:1) to (1:0.55.)

The equivalent ratio of epoxide groups to hydroxyl group equivalents of the diols to functional groups of the epihalohydrins is 1:(0.4–0.7): (0.1–0.5).

The ratio of epoxide to fatty amine and acid (c) is so chosen, according to the invention, that a less than equivalent amount of epoxide is used, so that there is fewer than one epoxide group per sum of the amino and acid groups. The reaction products thus contain carboxyl end groups and are organosoluble, but are insoluble in water or can only be dispersed in aqueous medium.

Wherever amino group equivalents are mentioned in the following description reference is always made to the number of hydrogen atoms bound to amine nitrogen atoms.

The nitrogen-containing condensation product containing carboxylic acid groups as a rule has an acid number of 10 to 80, preferably 20 to 50.

The reaction with the component (h) is ordinarily carried out at temperatures of 60° to 105° C, preferably at about 100° C. In most cases, this reaction takes place in the presence of small amounts of organic solvent, for example n-butanol.

The reaction with the component (g) takes place, as already mentioned, simultaneously with that of component (f).

The condensation products so obtained, can be adjusted by addition of an organic solvent or water optionally accompanied by addition of conventional surfactants as dispersants, to a content of 10 to 40% of condensation product.

These solutions or dispersions are characterised by excellent stability. Suitable surfactants are e.g. adducts of ethylene oxide and fatty amines, alicyclic or fatty alcohols or fatty acids as well as sulphonates of fatty acids, fatty acid amides or fatty alcohols.

Possible organic solvents in the presence of which the reaction products are manufactured are, above all, water-soluble organic solvents, and in particular advantageously those which are miscible with water to an unlimited extent. Dioxan, isopropanol, ethanol and methanol, ethylene glycol n-butyl ether (=n-butylglycol), diethylene glycol monobutyl ether, dimethyl formamide and dimethylacetamide may be mentioned as examples.

Furthermore, it is also possible to carry out the reaction in the presence of water-insoluble organic solvents, for example in hydrocarbons, such as petroleum ether, benzene toluene and xylene, or in halogenated hydrocarbons, such as methylene chloride, methylene bromide, chloroform, carbon tetrachloride, ethylene chloride, ethylene bromide, s-tetrachloroethane and above all trichloroethylene.

The organic solvents or aqueous emulsions used according to the invention can contain in addition stabilisers against the harmful action of light. These stabilisers are known and are derived e.g. from monomeric aromatic compounds which contain at least one phenolic hydroxyl group, for example phenols which contain at least one sterically hindered hydroxyl group.

Suitable stabilisers have, for example, the formula

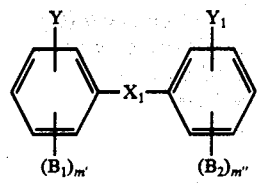

(36)

wherein $B_1$ and $B_2$ represent alkyl or alkoxy with 1 to 8 carbon atoms, $X_1$ represents alkylene with 1 to 4 carbon atoms, —CO—, —S— or —O—, Y and $Y_1$ represent hydrogen, hydroxyl or carboxyl, at least one of the substituents being hydroxyl, and $m'$ and $m''$ are integers from 1 to 4.

Particularly suitable stabilisers have the formula

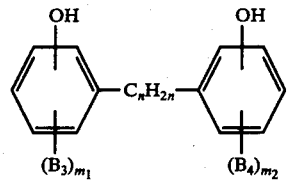

(37)

wherein $B_3$ and $B_4$ each independently represents alkyl with 1 to 6, preferably 1 to 4, carbon atoms, and $m_1$ and $m_2$ are the integers 1 or 2 and $n$ is an integer from 1 to 4.

Mention may be made, for example, of the following compounds:

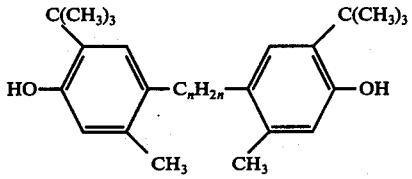

(38)

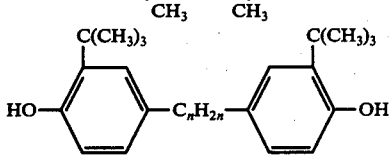

(39)

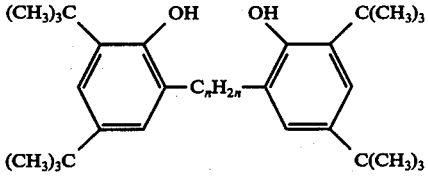

(40)

wherein $n$ in each case is an integer from 1 to 4, also

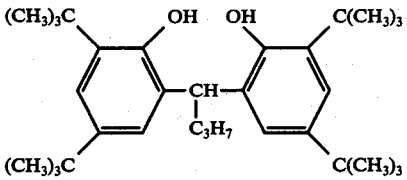

(41a)

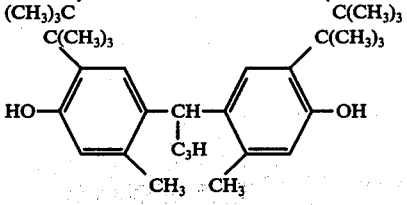

(41b)

-continued (41c)

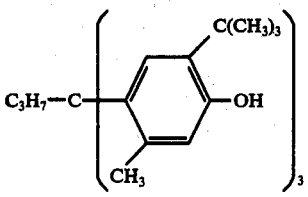

and (42)

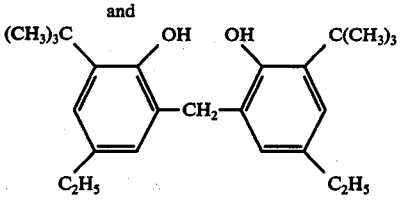

Suitable compounds are also those of the formula (43)

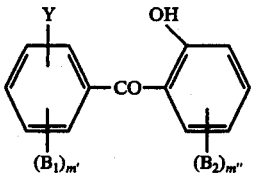

wherein $B_1$ and $B_2$ represent alkyl or alkoxy with 1 to 8 carbon atoms, Y represents hydrogen, hydroxyl or carboxyl, and i m' and *m''* are integers from 1 to 4, or those of the formula (44)

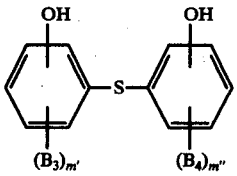

wherein $B_3$ and $B_4$ represent alkyl with 1 to 6, preferably 1 to 4 carbon atoms, and *m'* and *m''* are integers from 1 to 4.

The compounds of the formula (45)

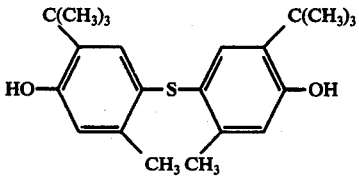

may be cited as an example of these last mentioned compounds.

Also of interest are the stabilisers of the formulae (46)

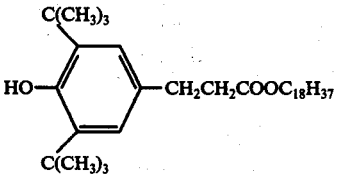

and

-continued (47)

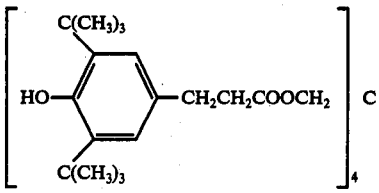

The process according to the invention is carried out by using organic solutions or aqueous emulsions which contain 0.6 to 5%, preferably 0.5 to 3%, of the polythiols, 0.1 to 1% of the nitrogen-containing condensation products and, optionally, 0.01 to 0.2% of a stabiliser against the harmful action of light. The percentages refer in each case to the weight of the keratinous material.

The term "keratinous material" as used throughout this specification includes all forms of keratinous fibers or fabrics and garments made therefrom, e.g. fleeces, tops, card slivers, noils, yarns, threads, pile fabrics, non-woven fabrics, woven fabrics and knitted goods. In most cases the treatment will be applied to fabrics or made-up garments though it is quite feasible, and may be desirable in some circumstances, to shrink-resist fibers, e.g. in the form of tops. The material to be treated can consist either wholly of keratinous fibers or of blends of these fibers with synthetic fibrous and filamentary material such as polyamides, polyesters, and poly(acrylonitrile), and with cellulosic and regenerated cellulosic material. In general, however, the material should contain at least 30% by weight of keratinous fibers and better results are obtained with 100% keratinous fiber-containing material.

The keratinous material may be virgin or reclaimed: preferably, though not exclusively, it is sheep's wool. It may also be derived from alpaca, cashmere, mohair, vicuna, guanaco, camel hair, silk, and llama, or blends of these materials with sheep's wool. The keratinous material can furthermore by dyed or undyed.

The cited preparations, which are in the form of organic solutions or aqueous emulsions, can be applied to the material in the conventional manner, e.g. by the padding method. Wool tops or piece goods are, for example, immersed or padded. Finished or semi-finished articles are expediently sprayed or, still more advantageously, rotated in an organic solvent. Examples of suitable solvents are aliphatic alcohols with 1 to 4 carbon atoms, e.g. ethanol or isopropanol, ketones, e.g. ethyl methyl ketone, benzene, toluene, xylene or halogenated hydrocarbons which contain at most three carbon atoms, e.g. carbon tetrachloride, chloroform, trichloroethylene etc.

The application can be effected at temperatures of 20° C to 80° C, preferably at 20° C to 40° C, and at pH values of 6 to 12, preferably of 7.5 to 11. The treated material is subsequently thoroughly dried at temperatures of 70° C to 150 ° C, preferably 80° C to 120° C (optionally in the presence of a catalyst). The complete curing (fixation) of the finish applied to the substrate can be achieved by additional storage up to a maximum time of 12 hours.

Substances found to be useful as catalysts include organic or inorganic Bronsted bases and acids, and free-radical catalysts. The last are of general applicability, and include organic and inorganic peroxides and persalts such as benzoyl peroxides, hydrogen peroxide, tert.butyl hydroperoxide, di-isopropyl peroxydicarbonate, and ammonium persulphate. Examples of suitable such acids are sulphuric, phosphoric, and hydrochloric acids, also aromatic sulphonic acids such as toluene-p-sulphonic acid. Examples of bases are primary, secondary and tertiary amines, such as triethylamine and N-benzyldimethylamine, and especially alkanolamines, e.g., mono-, di-, and tri-ethanolamine, and alkylenepolyamines, e.g. ethylenediamine, diethylenetriamine, tetra-ethylenepentamine, propane-1,2-diamine, propane-1, 3-diamine, and hexamethylenediamine, also quaternary ammonium hydroxides such as tetramethylammonium hydroxide, inorganic hydroxides (especially sodium hydroxide), and inorganic alkaline-reacting salts such as trisodium phosphate, sodium carbonate, sodium bicarbonate, sodium pyrophosphate, and sodium acetate.

The amount of catalyst can vary within wide limits; as a rule it is 0.1% to 20% by weight, based on the total weight of the polythiol used.

Besides the polythiols, the nitrogen-containing condensation products and, optionally, the stabilisers against the harmful action of light, the preparations used for the process according to the invention can contain still further components, e.g. the requisite amount of alkali for adjusting the pH, for example sodium hydroxide or sodium carbonate, also surfactants, fabric softeners, bleaches, thickeners, or also other resins and resin formers, e.g. epoxy resins and aminoplast precondensates. The aminoplast precondensates, for example, can be same as those used as component (h) for the manufacture of the nitrogen-containing condensation products (2).

If the preparations used according to the invention contain aminoplast precondensates, then as component (2) there are preferably used those condensation products which are obtained without the use of component (h).

The keratinous material modified by the process according to the invention is characterized above all by good shrink-resist, non-felting and durable press effects.

The treatment according to the invention, whether to achieve shrink-resist or durable press results, provides fibers or garments which will withstand washing in machines and still retain their original dimension and shape. In addition to the excellent handle obtained from material treated in accordance with the invention, the treated material also has good recovery from wrinkling, which is an important attribute in fabrics employed in trousers where there is a strong tendency to wrinkles in the areas of the knee and back of the knee.

The resins used in the process according to the invention, as well as inhibiting or preventing felting shrinkage, also inhibit or prevent relaxation, shrinkage, and thus the present process finds particular application in the shrink-resist treatment of piece goods.

If a shrink-resist treatment is required, then it is usually convenient to apply the resin to the piece goods, although as previously stated it may be applied to the fibers in the form of tops or card slivers. The fabric may be "flat-set" before or after resin treatment. It should be stated, however, that flat-setting may not be necessary or even not desirable with certain types of cloth. Flat-setting is normally carried out either by treating the cloth with steam at superatmospheric pressure, or by treating the cloth with steam at atmospheric pressure in the presence of a setting agent and moisture and maintaining the cloth in a flat state. Flat-setting may also be achieved by applying high concentrations of a reducing agent and a swelling agent, and maintaining the cloth in a flat state during washing off the excess reagents. In another method flat-setting may be achieved by impregnating the material with a swelling agent and an alkanolamine carbonate, e.g. urea and ethanolamine carbonate, drying the material and semi-decatising the dried material.

If a durable press treatment is required, there are a number of ways in which this may be achieved. One method is to treat the material with polythiol resin, make the material up into garments or garment pieces and insert therein pleats or creases, using reducing agents, bases, or superheated steam as setting agents. The resin may be applied to the fibers at any stage during the manufacture of the fabric, e.g. in top form, in yarn, or in fabric form. If desired, agents which block the thiol groups of the wool, e.g. formaldehyde or higher aldehydes, may be applied to the creased or pleated garments after curing the polythiol resin.

A preferred method of applying the polythiol resin to obtain a durable press effect comprises treating the made-up garment or garment piece, which already has the desired creases or pleats imparted thereto, with the polythiol resin dissolved in an organic solvent. In this method it is essential that the resin is applied in an organic solvent because treatment with aqueous systems would only serve to remove the creases or pleats already set in the fabric.

An alternative method, which is primarily concerned with the production of durable press pleats or creases only, comprises impregnating the fabric in the area where a crease or pleat is to be inserted with the resin, imparting the crease or pleat, and maintaining it in this position whilst heat and pressure are applied.

The finishings also improve the mechanical properties, e.g. ultimate tensile strength, elongation, abrasion resistance, and tendency to pilling of the treated textile material.

Moreover, the finished material exhibits good and lasting stability to the harmful action of light. The action of light can lead to an oxidative or thermal degradation of the resins present on the substrates, which can then in turn lead to a loss of the finishing effects.

In the following Examples the parts and percentages are by weight.

MANUFACTURING INSTRUCTIONS - POLYTHIOL RESINS

Thiol resin A

A mixture of 800 g (0.2 g-mol.) of a triol of average molecular weight 4000 made from glycerol and propylene oxide, 55.2 g (0.6 g-mol.) of trioglycollic acid, 5 g of toluene-p-sulphonic acid, and 350 ml of toluene was heated to reflux with stirring in an atmosphere of nitrogen. Water (10.8 ml. 0.6 g-mol.) formed during the reaction was removed as its azeotrope with toluene. The mixture was cooled and washed with water, and the organic layer was separated. On removal under vacuum of the solvent from the organic layer there remained 793 g (94% of the theoretical yield) of the desired tris(thioglycollate) ("Thiol resin A"), having a mercaptan content of 0.59 equiv./kg.

Thiol resins B and C

These denote poly(2-hydroxy-3-mercaptoptopyl) ethers prepared from glycerol-propylene oxide adducts having an average molecular weight of 600 and 4800 respectively, epichlorohydrin, and sodium sulphide. The products had a mercaptan content of 3.7 equiv-/kg. and 0.32 equiv./kg. respectively.

Thiol resins D - S

These polymercaptan esters were prepared as described for Thiol resin A except that in the case of resins J - S perchloroethylene was used instead of toluene, and for resins D - I the reaction mixture was not washed with water: any unreacted mercapto-acid was removed, together with the remaining toluene (or perchloroethylene) by stripping the product under vacuum in a rotary evaporator. For resin P, no catalyst was used.

The materials employed to prepare these esters are shown in Table I.

Thiol resins T and U

These denote poly(2-hydroxy-3-mercaptopropyl) ethers similar to Thiol resins B and C.

Thiol resin T contained 2 - 3 —SH groups per molecule; its thiol content was 1.4 equiv./kg. and its molecular weight in the range 1500–2000. Thiol resin U contained approximately 3 —SH groups per molecule; its thiol content was 0.54 equiv./kg. and its average molecular weight was about 3000. (compare general formula (8).

Thiol resin V

A mixture of Thiol resin B (500 g), thioglycollic acid (218 g, 2.37 equiv.), toluene-p-sulphonic acid (1.5 g) and perchloroethylene (500 ml) was heated to reflux for 8 hours under nitrogen with entrainment of water formed (44 ml) during the reaction. After the mixture had been washed with water until its pH was 5 to 6, the solvent was stripped off in vacuo. The residue (640 g) had a thiol content of 5.7 equiv./kg. and contained 5–6 thiol groups per molecule.

Thiol resin W

A mixture of Thiol resin C (529 g), thioglycollic acid (19.5 g, 0.212 equiv.), toluene-p-sulphonic acid (1 g) and perchloroethylene (350 ml) was heated as before, 4 ml of water being evolved. The mixture was stirred with a slurry of sodium bicarbonate (5 g) and water (2.5 ml), filtered, and stripped in vacuo. The residue (532 g) had a thiol content of 0.58 equiv./kg. and contained 5–6 thiol groups per molecule.

Thiol resin X

This was prepared as described for Thiol resin V from "Thiol resin T" (500 g), 89 g of thioglycollic acid, 4 g of toluene-p-sulphonic acid, and 500 ml of perchloroethylene : 23 ml of water was entrained. The residue had a thiol content of 1.78 equiv./kg. and contained 5–6 thiol groups per molecule.

Thiol resin Y

This was prepared as described for Thiol resin X but using "Thiol resin U" (500 g) and 36.4 g of thioglycollic acid. The residue had a thiol content of 0.75 equiv./kg. and contained 5–6 thiol groups per molecule.

The other thiol resins were manufactured in analogous manner.

Table I

| | Polyol Adduct | | | | |
|---|---|---|---|---|---|
| | | | Prepared from | | |
| Polythiol | Manufacturer's Designation | Average mol. wt. | alkylene oxide | alcohol or amine | Esterifying Acid |
| D | Caradol 3000 | 3000 | PO | Glycerol | Thioglycollic |
| E | Caradol 5001 | 5000 | PO with EO tip | " | " |
| F | Polyurax G 1000 | 1000 | PO | " | " |
| G | Polyurax G 3000 | 3000 | PO | " | " |
| H | Polyurax G 3521 | 3000–4000 | EO/PO(10:90) | " | " |
| I | Polyurax G 1000 | 1000 | PO | " | 2-Mercapto-propionic |
| J | Caradol 5001 | 5000 | PO with EO tip | " | Thioglycollic |
| K | Polyurax G 1000 | 1000 | PO | " | " |
| L | Voranol CP 700 | 700 | PO | " | " |
| M | Caradol 3000 | 3000 | PO | " | " |
| N | Niax LHT 112 | 1500 | PO | Hexane-1, 2,6-triol | " |
| O | Polyurax G 4000 | 4000 | PO | Glycerol | 2-Mercapto-propionic |
| P | Pluracol EDP 500 | 500 | PO | Ethylene-diamine | Thioglycollic |
| Q | — | 2220 | PO | Pentaery-thritol | " |
| R | Pluracol TP 4040 | 4040 | PO | Trimethylol-propane | " |
| S | Polymeg 1000 | 1000 | Tetrahydro-furan | Butane-1,4-diol | " |

EO = Ethylene oxide
PO = Propylene oxide
'CARADOL', 'POLYURAX', 'VORANOL', 'NIAX', 'PLURACOL' and 'POLYMEG' are trade-marks, the 'CARADOL' products being available from Shell Chemical Co., the 'POLYURAX' products from B.P. Chemicals Ltd., the 'VORANOL' product from Dow Chemical Co., the 'NIAX' product from Union Carbide, the 'PLURACOL' products from Wyandotte Chemical Corp., and the 'POLYMEG' from The Quaker Oats Co. The polyol used to prepare Thiol resin Q was obtained in a known manner by reaction in the presence of sodium hydroxide.

Table II

| Poly-mercaptan | Components Substance | Molar ratio | Thiol content (equiv./kg) |
|---|---|---|---|
| | glycerol | 1 | |
| $A_1$ | adipic acid | 4 | 2.35 |
| | butane-1,4-diol | 4 | |
| | thioglycollic acid | 3 | |
| | trimerised linoleic acid* | 1 | |
| $B_1$ | Polyol I | 3 | 1.09 |
| | thioglycollic acid | 3 | |
| | Polyol II | 1 | |
| $C_1$ | mercaptosuccinic acid | 3 | 0.83 |

Table II-continued

| Poly-mercaptan | Components Substance | Molar ratio | Thiol content (equiv./kg) |
|---|---|---|---|
| | n-pentanol | 3 | |
| | Polyol II | 1 | |
| $D_1$ | adipic acid | 3 | 0.62 |
| | 2-mercaptoethanol | 3 | |
| | Polyol III | 3 | |
| $E_1$ | mercaptosuccinic acid | 2 | 1.15 |
| | thioglycollic acid | 2 | |
| | hexane-1,2,6-triol | 1 | |
| | dimerised linoleic acid** | 5 | |
| $F_1$ | hexane-1,6-diol | 4 | 0.94 |
| | thioglycollic acid | 2.5 | |
| | trimerised linoleic acid | 1 | |
| $G_1$ | butane-1,4-diol | 3 | 1.64 |
| | thioglycollic acid | 3 | |
| | Polyol IV | 1 | |
| $H_1$ | adipic acid | 3 | 1.78 |
| | butane-1,4-diol | 3 | |
| | thioglycollic acid | 3 | |
| | hexane-1,2,6-triol | 1 | |
| | dimerised linoleic acid | 2 | |
| $J_1$ | | | 0.99 |
| | Polyol V | 2 | |
| | thioglycollic acid | 3 | |
| | glycerol | 1 | |
| | adipic acid | 2 | |
| $K_1$ | | | 2.07 |
| | Polyol V | 2 | |
| | thioglycollic acid | 3 | |
| | 1,1,1-trimethylolpropane | 1 | |
| | succinic acid | 4 | 0.82 |
| $L_1$ | mixed diprimary alcohols*** | 4 | |
| | thioglycollic acid | 3 | |
| | trimerised linoleic acid | 1 | |
| | butane-1,4-diol | 3 | 2.11 |
| $M_1$ | 3-mercaptopropionic acid | 3 | |
| | 1,1,1-trimethylolpropane | 1 | |
| | adipic acid | 2 | |
| $N_1$ | | | 1.95 |
| | Polyol I | 2 | |
| | 3-mercaptopropionic acid | 3 | |
| | 1,1,1-trimethylolpropane | 1 | |
| | adipic acid | 2 | |
| $C_1$ | 2,2-bis(p-hydroxypropoxy) | | 1.63 |
| | phenyl)propane | 2 | |
| | thioglycollic acid | 3 | |
| | glycerol | 1 | |
| | adipic acid | 4 | |
| $P_1$ | | | 1.10 |
| | Polyol I | 4 | |
| | thioglycollic acid | 3 | |
| | Polyol IV | 1 | |
| | adipic acid | 3 | |
| $Q_1$ | 2,2-bis(p-hydroxypropoxy) | | 1.36 |
| | phenyl)propane | 3 | |
| | thioglycollic acid | 3 | |
| | trimerised linoleic acid | 1 | |
| $R_1$ | Polyol VI | 3 | 0.85 |
| | thioglycollic acid | 3 | |
| | Polyol II | 1 | |
| | succinic anhydride | 3 | 0.48 |
| $S_1$ | 2-mercaptoethanol | 3 | |
| | Polyol VI | 1 | |
| $T_1$ | dimerised linoleic acid | 4 | |
| | 2-mercaptoethanol | 4 | |
| | glycerol | 1 | |
| $U_1$ | phthalic anhydride | 4 | |
| | butane-1,4-diol | 4 | |
| | thioglycollic acid | 3 | |
| | Polyol VIII | | |
| $V_1$ | | 11 | 0.40 |
| | mercaptosuccinic acid | 10 | |
| | Polyol I | | |
| $W_1$ | | 11 | 1.65 |
| | mercaptosuccinic acid | 10 | |
| $X_1$ | butane-1,4-diol | 6 | |
| | mercaptosuccinic acid | 5 | 3.98 |
| | mixed diprimary alcohols | 2 | |
| $Y_1$ | mercaptosuccinic acid | 1 | 1.79 |
| | thioglycollic acid | 2 | |
| $Z_1$ | Polyol I | 11 0.93 | |
| | mercaptosuccinic acid | 6 | |
| | adipic acid | 4 | |
| | acetic acid | 2 | |

*The trimerised linoleic acid, having an average molecular weight of about 800 and a carboxyl content of about 3.4 equiv./kg., was obtained from Unilever-Emery N.V., Gouda, Holland, under the designation "Trimer acid Empol 1043".

**The dimerised linoleic acid, obtained from the same source under the designation "Dimer acid Empol 1022", had an average molecular weight of about 570 and a carboxyl content of about 3.4 equiv./kg.

***The mixed diprimary alcohols had an average molecular weight of about 700 and a hydroxyl value of 155–165 and are prepared by catalytic hydrogenation of methyl esters of long chain aromatic-aliphatic fatty acids which are Diels-Alder adducts of styrene with ethylenically unsaturated acids such as linoleic acid. The alcohols were obtained under the designation "Comerginol 65" from Bibby Chemicals Ltd., Liverpool, England.

Polyol I, polyol III and polyol VIII are poly(oxypropylene)glycols of average molecular weight 425, 1000 and 2000 respectively;

Polyol IV and polyol II are glycerol-propylene oxide adducts of average molecular weight 700 and 3000 respectively;

polyol VII is an adduct of pentaerythritol and propylene oxide of average molecular weight 650;

polyol V and polyol VI are poly(oxyethylene)glycols of average molecular weight 400 and 300 respectively.

Manufacturing instructions — Nitrogen — containing condensation products

1. A mixture of 98 g (0.5 epoxide group equivalent) of the epoxide described in Manufacturing instruction 19, 54.2 g (0.35 amino group equivalent) of a mixture of 1-aminoeicosane and 1-amino-docosane and 50.5 g of sebacic acid (0.5 acid group equivalent) is stirred for 2 hours at 100° C, in a nitrogen atmosphere. After dilution with 202.7 g of ethylene glycol monobutyl ether, a 50% strength product of medium viscosity, having an acid number of 57.8 is obtained.

2. A mixture of 98 g (0.5 epoxide group equivalent) of the epoxide described in Manufacturing instruction 19, 31 g of a mixture of 1-amino-eicosane and 1-amino-docosane (0.2 amino group equivalent) and 50 g of n-butylglycol is stirred for 3 hours at 100° C. Then 40.1 g of pimelic acid (0.5 acid group equivalent) are added and the mixture is again stirred for 3 hours at 100° C internal temperature. Thereafter it is diluted with 119 g of n-butylglycol and further stirred until cold. A clear product of medium viscosity, having an acid number of 70, is obtained 3. A mixture of 98 g (0.5 epoxide group equivalent) of the epoxide according to manufacturing instruction 19, 31 g (0.2 amino group equivalent) of a mixture of 1-amino-eicosane and 1-amino-docosane and 50 g of butylglycol is stirred for 3 hours at 100° C internal temperature. Then 58.6 of dodecane-dicarboxylic acid (0.5 acid group equivalent) are added, and the mixture is again stirred for 3 hours at 100° C internal temperature. After dilution with 137 g of n-butylglycol, a clear product of medium viscosity is obtained, having an acid number of 65.5.

4. A mixture of 98 g (0.5 epoxide group equivalent) of the epoxide according to manufacturing instruction 19, 31 g (0.2 amino group equivalent) of a mixture of 1-amino-eicosane and 1-amino-docosane and 50 g of butylglycol is stirred for 3 hours at 100° C internal temperature. Then 14.75 g of 1,6-hexanediol (0.25 hydroxyl group equivalent) and 50.5 g of sebacic acid (0.5 acid group equivalent) are added, and the mixture is again stirred for 3 hours at 100° C internal temperature.

Thereafter it is diluted with 144 g of n-butylglycol and further stirred until cold. A clear product of medium viscosity, having an acid number of 63, is obtained.

5. A mixture of 98 (0.5 epoxide group equivalent) of the epoxide according to manufacturing instruction 19, 54.2 g (0.35 amino group equivalent) of a mixture of 1-amino-eicosane and 1-amino docosane and 50 g of n-butylglycol is stirred for 5 hours at 100° C internal temperature. Then 60.6 g of sebacic acid (0.6 acid group equivalent) are added and the mixture is stirred for a further 5 hours at 100° C internal temperature. After adding 16.2 g of epichlorohydrin (0.175 mol), the mixture is again stirred for 5 hours at 100° C internal temperature. Thereafter it is diluted with 179 g of n-butylglycol and further stirred until cold. A clear product of medium viscosity, having an acid number of 64, is obtained.

6. A mixture of 98 g (0.5 epoxide group equivalent) of an epoxide according to manufacturing instruction 19, 31 g (0.2 amino group equivalent) of a mixture of 1-amino-eicosane and 1-amino-docosane and 50 g of n-butylglycol is stirred for 3 hours at 100° C internal temperature. Then 17.7 g of 1,6-hexanediol (0.3 hydroxyl group equivalent) and 50.5 g of sebacic acid (0.5 acid group equivalent) is added and the mixture is again stirred for 3 hours at 100° C internal temperature. After adding 4.6 g of epichlorohydrin (0.05 mol) the mixture is stirred for a further 3 hours at 100° C internal temperature and subsequently diluted with 151.8 g of n-butylglycol, and further stirred until cold. A clear, mobile product, having an acid number of 43.6, is obtained.

7. A mixture of 98 g (0.5 epoxide group equivalent) of the epoxide described in manufacturing instruction 19, 31 g of a mixture of 1-amino-eicosane and 1-amino-docosane (0.2 amino group equivalent) and 50 g of n-butylglycol is stirred for 3 hours at 100° C internal temperature. Then 14.75 g of 1,6-hexanediol (0.25 hydroxyl group equivalent) and 50.5 g of sebacic acid (0.5 acid group equivalent) is added and the mixture is again stirred for 3 hours at 100° C internal temperature. After cooling to 60° C internal temperature, 6.5 g of glycerol dichlorohydrin (0.05 mol are added and the mixture is stirred for 3 hours at 60° C internal temperature. Then 150.7 g of n-butylglycol are added and the mixture if further stirred until cold. A clear product of medium viscosity, having an acid number of 61.5, is obtained.

8. A mixture of 98 g (0.5 epoxide group equivalent) of the epoxide described in manufacturing instruction 19, 31 g of a mixture of 1-amino-eicosane and 1-amino-docosane (0.2 amino group equivalent) and 50 g of n-butylglycol is stirred for 3 hours at 100° C internal temperature. Then 44.5 g of polypropylene glycol (0.1 mol) and 50.5 g of sebacic acid (0.5 acid group equivalent) is added and the mixture is again stirred for 3 hours at 100° C internal temperature. After adding 9.25 g of epichlorohydrin (0.1 mol), the mixture is stirred for a further 3 hours at 100° C internal temperature, and 183.25 g of n-butylglycol are then added. A clear product of medium viscosity, having an acid number of 31, is obtained.

9. A mixture of 98 g (0.5 epoxide group equivalent) of the epoxide described in manufacturing instruction 19, 18.6 g od laurylamine (0.2 amino group equivalent) and 45 g of n-butylglycol is stirred for 3 hours at 100° C internal temperature. Then 50.5 g of sebacic acid (0.5 acid group equivalent) are added and the mixture is again stirred for 3 hours at 100° C internal temperature. Thereafter 5.3 g of acrylonitrile (0.1 mol) are added and the mixture is stirred for a further 3 hours at 100° C internal temperature. After adding 127 g of n-butylglycol, the mixture is further stirred until cold, and a clear product of medium viscosity, having an acid number of 65.8, is obtained.

10. A mixture of 98 g (0.5 epoxide group equivalent) of the epoxide described in manufacturing instruction 19 31 g (0.2 amino group equivalent) of a mixture of 1-amino-eicosane and 1-amino docosane and 50 g of n-butylglycol is stirred for 3 hours at 100° C. Then 22.5 g (0.3 hydroxyl group equivalent) of triethyleneglycol and 50.5 g (0.5 acid group equivalent) of sebacic acid are added and the mixture is again stirred for 3 hours at 100° C internal temperature. After adding 4.6 g of epichlorohydrin (0.05 mol) the mixture is again stirred for 3 hours at 100° C internal temperature. After dilution with 156.6 g of n-butylglycol, the mixture is further stirred until cold. A clear product of medium viscosity, having an acid number of 48, is obtained.

11. A mixture of 98 g (0.5 epoxide group equivalent) of the epoxide described in manufacturing instruction 19 31 g (0.2 amino group equivalent) of a mixture of 1-amino-eicosane and 1-amino-docosane and 50 g of n-butylglycol is stirred for 3 hours at 100° C internal temperature. Then 15.9 g of diethylene glycol (0.3 hydroxyl group equivalent) and 50.5 g of sebacic acid (0.5 acid group equivalent) are added and the mixture is again stirred for 3 hours at 100° C internal temperature. After adding 4.6 of epichlorohydrin (0.05 mol) the mixture is stirred for a further 3 hours at 100° C internal temperature. After adding 150 g of n-butylglycol, the mixture is further stirred until cold. A clear product of medium viscosity, having an acid number of 47.8, is obtained.

12. A mixture of 98 g (0.5 epoxide group equivalent) of the epoxide described in manufacturing instruction 19 31 g (0.2 amino group equivalent) of a mixture of 1-amino-eicosane and 1-amino-docosane and 50 g of n-butylglycol is stirred for 3 hours at 100° C internal temperature. Then 15.6 g of neonpentylglycol (0.3 hydroxyl group equivalent) and 50.5 g of sebacic acid (0.5 acid group equivalent) are added and the mixture is again stirred for 3 hours at 100° C internal temperature. After adding 4.6 g of epichlorohydrin (0.05 mol) the mixture is again stirred for 3 hours at 100° C internal temperature.

After dilution with 149.7 g of n-butylglycol, the mixture is further stirred until cold. A clear product of medium viscosity, having an acid number of 47.5, is obtained.

13. A mixture of 392 g of an epoxide according to manufacturing instruction 19 (2 epoxide equivalents), 310 g (2 amino group equivalent) of a mixture of 1-amino-eicosane and 1-amino-docosane and 200 g of dioxane is stirred for 3 hours at 100° C internal temperature. Then 70.8 g of 1,6-hexanediol (1.2 hydroxyl group equivalents) and 202 g of sebacic acid (2 acid group equivalents) are added and the mixture is stirred for a further 3 hours at 100° C internal temperature. Then 37 g of epichlorohydrin (0.4 mol) are added and the mixture is stirred for a further 3 hours at 100° C internal temperature. Thereafter the mixture is diluted with 812 g of dioxane and further stirred until cold. A solution of medium viscosity having an acid number of 81.5, is obtained.

14. A mixture of 98 g of an epoxide according to manufacturing instruction 19 (0.5 epoxide equivalent), 31 g (0.2 amino group equivalent) of a mixture of 1-amino-eicosane and 1-amino-docosane and 50 g of butylglycol is stirred for 3 hours at 100° internal temperature. Then 15.6 g of neopentylglycol (0.3 hydroxyl group equivalent) and 50.5 g of sebacic acid (0.5 acid group equivalent) are added and the mixture is stirred for a further 3 hours at 100° C internal temperature. Then 9.25 g of epichlorohydrin (0.1 mol) are added and the mixture is again stirred for a further 3 hours at 100° C internal temperature. Thereafter it is diluted with 154 g of trichloroethylene and further stirred until cold. A clear solution of medium viscosity, haing an acid number of 36, is obtained With rapid stirring 100 g of the 50% strength product described and 10 g of the 50% strength solution of an addition product of 70 mols of ethylene oxide to a fatty amine mixture ($C_{16}$–$C_{22}$) are mixed and slowly diluted with 140 g of deionised water. A mobile emulsion of fine particle size is obtained, wherein the active substance content is 20. 15.

A mixture of 98 g of an epoxide according to manufacturing instruction 19 (0.5 epoxide equivalent), 31 g (0.2 amino group equivalent) of a mixture of 1-amino-eicosane and 1-amino-docosane and 50 g of butylglycol is stirred for 3 hours at 100° C internal temperature. Then 17.7 g of 1,6-hexanediol (0.3 hydroxyl group equivalent) and 50.5 g of sebacic acid (0.5 acid group equivalent are added and the mixture is again stirred for 3 hours at 100° C internal temperature. Then 5.8 g of hydroxyethyl acrylate (0.05 ml) are added and the mixture is stirred for a further 3 hours at 100° C internal temperature.

After dilution with 147.6 g of butylglycol, the mixture is further stirred until cold. A clear solution of medium viscosity, having a acid number of 66, is otained.

16. A mixture of 98 g of an epoxide according to manufacturing instruction 19 (0.5 epoxide equivalent), 31 g of a mixture of 1-amino-eicosane and 1-amino-docosane (0.2 amino group equivalent) and 55.5 g of butylglycol is stirred for 3 hours at 100° C internal temperature. Then 17.7 g of 1,6-hexanediol (0.3 hydroxyl group equivalent) and 50.5 g of sebacic acid (0.5 acid group equivalent) are added and the mixture is again stirred for 3 hours at 100° C internal temperature.

then 3.5 g of acrylic acid (0.05 mol) are added and the mixture is stirred for a further 3 hours at 100° C internal temperature. After dilution with 145.4 g of butylglycol, the mixture is further stirred until cold. A clear solution of medium viscosity having an acid number of 71.5 is obtained.

17. A mixture of 98 g of epoxide according to manufacturing instruction 19 (0.5 epoxide equivalent), 31 g of a mixture of 1-amino-eicosane and 1-amino-docosane (0.2 amino group equivalent) and 55.5 g of butylglycol is stirred for 3 hours at 100° C internal temperature. Then 17.7 g of 1,6-hexanediol (0.3 hydroxyl group equivalent) and 50.5 g of sebacic acid (0.5 acid group equivalent) are added and the mixture is again stirred for 3 hours at 100° C internal temperature. Then 3.2 g of glycidyl methacrylate (0.025 mol) are added and the mixture is again stirred for 3 hours at 100° C internal temperature. After dilution with 145.4 g of butylglycol, the mixture is further stirred until cold. A clear solution of medium viscosity, having an acid number of 56.9, is obtained.

18. A mixture of 98 g of an epoxide according to manufacturing instruction 19 (0.5 epoxide equivalent), 31 g of a mixture of 1-amino-eicosane and 1-amino-docosane (0.2 amino group equivalent) and 55.5 g of butylglycol is stirred for 3 hours at 100° C internal temperature. Then 17.7 g of 1,6-hexanediol and 50.5 g of sebacic acid are added and the mixture is again stirred for 3 hours at 100° C internal temperature. Thereafter, 5.1 g of methylolacrylamide (0.05 mol) are added and the mixture is again stirred for 3 hours at 100° C internal temperature. After adding 146.9 g of butylglycol, the mixture is further stirred until cold.

A clear mobile solution of acid number 59 is obtained.

19. A mixture of 98 g of an epoxide formed from 2,2-bis-(4'-hydroxyphenyl) propane and epichlorohydrin (0.5 epoxide group equivalent), 54.2 g of a mixture of 1-amino-eicosane and 1-amino-docosane. (0.35 amino group equivalent) and 47 g of azelaic acid (0.5 acid group equivalent) is stirred for 2 hours at 100° C internal temperature in a nitrogen atmosphere. An 80% strength solution of 54.2 g of hexamethylolmelamine dibutyl and tributyl ethers (that is to say a mixture of di-and tri-n-butyl ethers of a highly methylolated melamine) in n-butanol is then added, and the mixture is again stirred for 1 hour at 100° C. Dilution with 240 g of ethylene glycol monobutyl ether yields a 50% strength product of medium viscosity, having an acid number of 46.4.

20. A mixture of 98 g (0.5 epoxide group equivalent) of the epoxide described in manufacturing instruction 19 54.2 g (0.35 amino group equivalent) of a mixture of 1-aminoeicosane and 1-amino-docosane and 50.5 g (0.5 acid group equivalent) of sebacic acid is stirred for 5 hours in a nitrogen atmosphere at 100° C internal temperature. An 80% strength solution of 54.2 g of hexamethylolmelamine di- and tri-butyl ethers in butanol is then added, the mixture is again stirred for 1 hour at 100° C. Dilution with 243 g of ethylene glycol monobutyl ether yields a 50% strength product of medium viscosity, having an acid number of 45.

A mixture of 98 g (0.5 epoxide group equivalent) of the epoxide described in manufacturing instruction 19, 5.42 g (0.35 amino group equivalent of a mixture of 1-aminoeicosane and 1-amino-docosane and 45.4 g (0.45 acid group equivalent) of sebacic acid is stirred for 2 hours at 100° C internal temperature in a nitrogen atmosphere. An 80% strength solution of 54.2 g of hexamethylolmelamine di- and tributyl ethers in butanol is then added, and the mixture is again stirred for 1 hour at 100° C. Dilution with 238 g of ethylene glycol monobutyl ether yields a 50% strength product of medium viscosity, having an acid number of 41.3.

22. A mixture of 98 g (0.5 epoxide group equivalent) of the epoxide described in manufacturing instruction 19, 54.2 g of a mixture of 1-amino-eicosane and 1-amino-docosane (0.35 amino group equivalent) and 47 g of azelaic acid (0.5 acid group equivalent) is warmed for 2 hours at 100° C internal temperature. An 80% strength solution of 54.2 g of hexamethylolmelamine di- and tri-butyl ethers in n-butanol is then added and the mixture is again stirred for 1 hour at 100° C internal temperature. Dilution with 240 g of n-butylglycol yields a clear product of medium viscosity, having an acid number of 48.2.

23. A mixture of 98 g (0.5 epoxide group equivalent) of the epoxide described in manufacturing instruction 19, 31 g of a mixture of 1-amino-eicosane and 1-amino-docosane (0.2 amino group equivalent) and 50 g of n-butylglycol is stirred for 2 hours at 100° C internal temperature. Then 50.5 g of sebacic acid (0.5 acid group equivalent) are added and the mixture is stirred for a further 2 hours at 100° C internal temperature. After adding 12.4 g of ethylene glycol (0.4 hydroxyl group equivalent), the mixture is stirred for a further 2 hours at 100° C internal temperature. An 80% strength solution of 54.2 g of hexamethylolmelamine di- and tri-butyl ether in n-butanol is then added and the mixture is stirred for 2 hours at 100° C internal temperature. After dilution with 182 g of n-butylglycol, a clear product of medium viscosity, having an acid number of 42.9, is obtained.

A mixture of 98 g (0.5 epoxide group equivalent) of the epoxide described in manufacturing instruction 19, 31 g of a mixture of 1-amino-eicosane and 1-amino-docosane (0.2 amino group equivalent) and 50 g of n-butylglycol is stirred for 3 hours at 100° C internal temperature. Then 17.7 g of 1,6-hexanediol (0.3 hydroxyl group equivalent) and 50.5 of sebacic acid (0.5 acid group equivalent) are added and the mixture is again stirred for 3 hours at 100° C internal temperature. After adding 4.6 g of epichlorohydrin (0.05 mol), the mixture is stirred for a further 3 hours at 100° C internal temperature. After dilution with 207.9 g of n-butylglycol, the product is cooled to 70° C internal temperature, and an 80% strength solution of 93.5 of hexamethylolmelamine di- and tri-butyl ethers in n-butanol is added, and the mixture again stirred for 30 minutes at 70° C internal temperature. Thereafter it is cooled to room temperature, 25. A mixture of 98 g of epoxide described manufacturing instructions 19 (0.5 epoxide group equivalent), 31 g of a mixture of 1-amino-eicosane and 1-amino-docosane (0.2 amino group equivalent = hydrogen atoms bonded to amino nitrogen) and 50 g of dimethyl formamide is stirred for 15 minutes at 100° C internal temperature. Then 15.6 g of neopentyl glycol (0.3 hydroxyl group equivalent) and 50.5 g of sebacic acid (0.5 acid group equivalent) are added and stirring is continued for 3 hours at 100° C internal temperature.

Then 13.9 g of epichlorohydrin (0.15 g-mol.) are added and stirring is again continued for 3 hours at 100° C internal temperature. Dilution with 159 g of perchloroethylene yields a 50% product of average viscosity with an acid number of 28.4.

100 g of the 50% product are then treated with 12 g of a 50% aqueous solution of hydroabiethylamine and 80 g-mols. of ethylene oxide and thoroughly mixed. A solution of 2 g of diammonium phosphate in 52.5 g of water (deionised) is then slowly added and the mixture is subsequently emulsified for 5 minutes. A finely disperse emulsion of low viscosity with a resin content of 30% is obtained. (pH = 6.8). 26. A mixture of 49 g of the epoxide described in manufacturing instruction-19 (0.25 epoxide equivalent), 27 g of stearylamine (0.1 amino equivalent) and 50 g of butyl glycol is stirred for 1 hour at 100° C internal temperature. Then 7.8 g of neopentyl glycol (0.15 hydroxyl group equivalent) and 25.2 g of sebacic acid (0.25 acid equivalent) are added and stirring is continued for 3 hours at 100° C internal temperature. Subsequently 7 g of epichlorohydrin (0.075 g-mol.) are added and stirring is again continued for 2 hours at 100° C internal temperature.

Then 196 g of a 80% solution of hexamethylol melamine dibutyl and tributyl ether in butanol are added and stirring is continued for 1 hour at 100° C internal temperature. Dilution with 183 g of perchloroethylene yields a clear 50% resin solution. Acid number: 24.

500 g of this 50% resin solution are mixed together with 60 g of a 50% aqueous solution of an adduct of hydroabietyl alcohol and 200 g-mols. of ethylene oxide, crosslinked with 1% hexamethylene-1,6-diisocyanate and 24 g of a 50% aqueous solution of an adduct of hydroabiethylamine and 70 g-mols. of ethylene oxide.

A finely disperse emulsion is obtained after addition of 668 g of water and using an emulsifying device. Resin content: 20%, pH = 5.1.

USE EXAMPLES

EXAMPLES 1

A double knit, pure wool fabric is impregnated with the following preparation and squeezed out to a liquor pick-up of 80%:

| | |
|---|---|
| 100 | parts of thiol A (40% aqueous emulsion) |
| 20 | parts of a 30% emulsion according to Manufacturing Instruction (14) |
| 2 | parts of an adduct of p-tert. nonylphenol and 9 moles of ethylene oxide (75% aqueous solution) |
| 20 | parts of sodium carbonate |
| 858 | parts of water |
| 1000 | parts of padding liquor |

The fabric is padded and then thoroughly dried, e.g. 4 mins. at 120° C. The fabric is stored for 12 hours and has a non-felting effect according to IWS Specification 72. The finished material is tested for its non-felting properties. The following results are obtained:

Comparative Non-Felting Tests according to IWS Specification 72

| Finish | Tested 12 hours after drying % shrinkage | Tested 6 weeks after drying % shrinkage | Exposure up to 4000 Langley units % shrinkage |
|---|---|---|---|
| Treated according to Example | 1) 2% | 2% | 3) 2% |
| Treated according to Example (without 14) | 18% | 2) 3% | 50% |
| Untreated fabric | 57% | 57% | 57% |

1) The complete fixation of the resin on the fibres is terminated after a maximum period of 12 hours.
2) Without the addition of (14), the curing (fixation) lasts about 4 to 6 weeks.
3) The non-felting properties of the material finished according to the invention remain unchanged after exposure to light.

IWS Specification 72:

| | | |
|---|---|---|
| Liquor: | 88.2 g | of monosodium phosphate $NaH_2PO_4 \cdot 6H_2O$ |
| | 120 g | of disodium phosphate $Na_2HPO_4$ (anhydrous) |
| | 15 l | of liquor |

Liquor ratio: 1:15
Wash for 3 hours in a cubex at 40° C, then rinse. Maximum shrinkage: 10%.

EXAMPLE 2

A wool fabric (180 g/m²) is impregnated with the following preparation and squeezed out to a pick-up of 70%:

| | |
|---|---|
| 90 | parts of thiol B (40% aqueous emulsion) |
| 20 | parts of a 30% aqueous emulsion according to Manufacturing Instruction (25) |
| 2 | parts of an adduct of p-tert. nonylphenol and 9 mols of ethylene oxide (75% aqueous solution) |
| 20 | parts of sodium carbonate |
| 868 | parts of water |
| 1000 | parts of padding liquor |

The material is padded and then dried for 2 hours at 80° C. The non-felting effect is determined before and after exposure. The finished material satisfies the requirements of IWS Specification 72.

Results: Shrinkage (%) 6.2 (unexposed); 5.5 (exposed with 3000 langley units).

The other thiols and nitrogen-containing condensation products can also be used in analogous manner.

EXAMPLE 3

The application procedure described in Example 2 is repeated with the described preparation, but using 30 parts of a 20% aqueous emulsion according to Manufacturing Instruction (26). The following results are obtained:

Shrinkage (%): 5.0 (unexposed); 5.0 (exposed, 3000 Langley units).

EXAMPLE 4

A wool fabric (180 g/m²) is impregnated with the following preparation and squeezed out to a pick-up of 100%:

| | |
|---|---|
| 30 | parts of thiol A |
| 6 | parts of the reaction product described in Manufacturing Instruction (5) |
| 964 | parts of chloroform |
| 1000 | parts of padding liquor |

The fabric is padded and then dried for 2 hours at 80° C. It is subsequently stored for 12 hours at room temperature. The shrinkage is 3.7% after exposure (3000 Langley units).

We claim:

1. A process for modifying keratinous material, which comprises treating said material with organic solutions or aqueous emulsions which contain
   1. polythiols with at least two thiol groups in the molecule and having a molecular weight of 400 to 20,000 and obtained from
      a. polyalcohols
      b. alkylene oxides and/or dicarboxylic acids and
      $c_1$. carboxylic acids containing thio groups, or from
      $c_2$. epihalohydrins and alkali metal hydrogen sulphides, the polythiols containing ether and/or ester bonds, or from
      $a_1$. polycarboxylic acids
      $b_1$. alkylene oxides or dialcohols and
      $c_1$. carboxylic acids containing thio groups,
   2. nitrogen-containing condensation products of epoxides which contain at least two epoxide groups in the molecule, fatty amines with 12 to 24 carbon atoms, dicarboxylic acids with 1 to 14 carbon atoms, the equivalent ratios of epoxide groups to hydrogen bound to amino nitrogen to carboxylic acid groups being 1:(0.1–1):(1–0.55), and subsequently drying the treated material.

2. A process according to claim 1, which comprises treating the material with organic solutions or aqueous emulsions which contain
   1. a polythiol with at least two thiol groups in the molecule and having a molecular weight of 400 to 10,000, of the formula $$\left[\mathrm{R}\right]\begin{matrix}[(-\text{O-alkylene})_m-\mathrm{OH}]_{q-1}\\ [(-\text{O-alkylene})_m-\mathrm{O(CO)}_{n-1}-X]_p\end{matrix},$$

wherein $m$ is an integer of at least 1 and may have different values in each of the $p$ and ($q$-1) chains, $n$ is 1 or 2, $P$ is at least 2, $(p+q)$ equals 3 to 7, each alkylene group contains a chain of 2 to 6 carbon atoms between consecutive oxygen atoms, R represents an aliphatic radical containing 2 to 6 carbon atoms, and X represents an aliphatic radical of 1 to 18 carbon atoms, containing at least one thiol group.

2. nitrogen-containing condensation product of at least
      d. an epoxide which contains at least two epoxide groups in the molecule,
      e. a fatty amine with 12 to 24 carbon atoms, and
      f. an aliphatic saturated dicarboxylic acid with 7 to 14 carbon atoms, and subsequently drying the treated material.

3. A process according to claim 2, wherein the polythiol has the formula $$\left[\mathrm{R}\right]\begin{matrix}[(-\text{O-alkylene})_m-\mathrm{OH}]_{q-1}\\ [(-\text{O-alkylene})_m-\mathrm{OCOC}_u\mathrm{H}_{2u}\mathrm{SH}]_p\end{matrix}$$

wherein R represents an aliphatic radical containing 2 to 6 carbon atoms, $m$ is an integer of at least 1 and may have different values in each of the $p$ and ($q$-1) chains, $p$ is at least 2, $(p+q)$ equals 3 to 7, each alkylene group contains a chain of 2 to 6 carbon atoms between consecutive oxygen atoms, and $u$ is 1 or 2.

4. A process according to claim 3, wherein the polythiol has the formula $$\left[\mathrm{R}_1\right]\begin{matrix}[(-\text{O-alkylene})_m\mathrm{OH}]_{q-1}\\ [(-\text{O-alkylene})_m\mathrm{OCOC}_u\mathrm{H}_{2u}\mathrm{SH}]_{p1}\end{matrix}$$

wherein $R_1$ represents an aliphatic radical with 2 to 6 carbon atoms, each alkylene group contains a chain of 2 to 6 carbon atoms between consecutive oxygen atoms and $m$ is an integer of at least 1 and may have different values in each of the $p_1$ and $(q-1)$ chains, $u$ is 1 or 2, and $p_1$ is 2 to 6.

5. A process according to claim 4, wherein the polythiol has the formula $$[\mathrm{R}_2][(\text{-O-alkylene})_m\mathrm{OCOC}_u\mathrm{H}_{2u}\mathrm{SH}]_{p2}$$

wherein $R_2$ represents a hydrocarbon radical with 3 to 6 carbon atoms and $p_2$ is an integer from 3 to 6 and wherein $m$ is an integer of at least 1 and may have different values in each of the $p_2$ and $(q-1)$ chains, each alkylene group contains a chain of 2 to 6 carbon atoms between consecutive oxygen atoms, and $u$ is 1 or 2.

6. A process according to claim 2, wherein the polythiol has the formula $$\left[\mathrm{R}\right]\begin{matrix}[(-\text{O-alkylene})_m\mathrm{OH}]_{q-1}\\ \left[(-\text{O-alkylene})_m\mathrm{OCH_2\underset{\underset{\mathrm{R_3}}{|}}{CH}CH_2SH}\right]_p\end{matrix}$$

wherein R represents an aliphatic radical containing 2 to 6 carbon atoms, $m$ is an integer of at least 1 and have different values in each of the $p$ and $(q-1)$ chains, $p$ is at least 2, $(p+q)$ equals 3 to 7 and each alkylene group contains a chain of 2 to 6 carbon atoms between consecutive oxygen atoms and $R_3$ represents —OH, —(O-alkylene)$_v$-OH, —OCOC$_u$H$_{2u}$-SH or —(O-alkylene)$_v$OCOC$_u$H$_{2u}$-SH, in which $v$ is at least 1

7. A process according to claim 6, wherein the polythiol has the formula $$[R_2]\,[(OC_tH_{2t})_mOCH_2\underset{\underset{OH}{|}}{C}HCH_2SH]_{P_2},$$

wherein $R_2$ represents an aliphatic hydrocarbon radical with 3 to 6 carbon atoms, $m$ is at least 1, $P_2$ is an integer from 3 to 6 and $t$ is 2 or 3.

8. A process according to claim 6, wherein the polythiol has the formula $$[R_2]\left[(-OC_tH_{2t})_mOCH_2\underset{\underset{OCOCH_2SH}{|}}{C}HCH_2SH\right]_{P_2}$$

wherein $R_2$ represents an aliphatic hydrocarbon radical with 3 to 6 carbon atoms, $m$ is at least 1, $p_2$ is an integer from 3 to 6 and $t$ is 2 or 3.

9. A process according to claim 5, wherein the polythiol have the formulae $$\begin{array}{l} CH_2-(OC_tH_{2t})_mO\,.\,CO\,.\,C_uH_{2u}SH \\ | \\ CH-(OC_tH_{2t})_mO\,.\,CO\,.\,C_uH_{2u}SH \\ | \\ CH_2-(OC_tH_{2t})_mO\,.\,CO\,.\,C_uH_{2u}SH \end{array}$$

and $$\begin{array}{l} CH_2-(OC_tH_{2t})_mO\,.\,CO\,.\,C_uH_{2u}SH \\ | \\ CH-(OC_tH_{2t})_mO\,.\,CO\,.\,C_uH_{2u}SH \\ | \\ (CH_2)_2 \\ | \\ \left[\begin{array}{l} CH \\ | \\ CH_2 \end{array}\right] \begin{array}{l} H \\ \\ -(OC_tH_{2t})_mO\,.\,CO\,.\,C_uH_{2u}SH \end{array} \end{array}$$

wherein $m$ is at least 1, $u$ is 1 or 2 and $t$ is 2 or 3.

10. A process according to claim 7, wherein the polythiol has the formula $$\begin{array}{l} CH_2-(OC_3H_6)_mOCH_2\underset{\underset{OH}{|}}{C}HCH_2SH \\ | \\ CH-(OC_3H_6)_mOCH_2\underset{\underset{OH}{|}}{C}HCH_2SH \\ | \\ CH_2-(OC_3H_6)_mOCH_2\underset{\underset{OH}{|}}{C}HCH_2SH \end{array}$$

wherein $m$ is at least 1 and the molecular weight is in the range from 700 to 6000.

11. A process according to claim 8, wherein the polythiol has the formula $$\begin{array}{l} CH_2-(OC_3H_6)_mOCH_2\underset{\underset{OCOCH_2SH}{|}}{C}HCH_2SH \\ | \\ CH-(OC_3H_6)_mOCH_2\underset{\underset{OCOCH_2SH}{|}}{C}HCH_2SH \\ | \\ CH_2-(OC_3H_6)_mOCH_2\underset{\underset{OCOCH_2SH}{|}}{C}HCH_2SH \end{array}$$

wherein $m$ is at least 1 and the molecular weight is in the range from 700 to 6000.

12. A process according to claim 9, wherein the polythiol has the formula $$\begin{array}{l} CH_2-(OC_3H_6)_mOCOCH_2SH \\ | \\ CH-(OC_3H_6)_mOCOCH_2SH \\ | \\ CH_2-(OC_3H_6)_mOCOCH_2SH\,. \end{array}$$

13. A process according to claim 1, wherein the polythiol is a polyester of the general formula $$W\left(\left(O\right)_rCO\left(O\right)_qZ\left(O\right)_qCO\left(O\right)_rYSH\right)_p$$

wherein $q$ and $r$ are zero or 1 but are not the same, $p$ is a positive integer of at most 6, Z represents a divalent organic radical, linked through a carbon atom or carbon atoms thereof to the indicated —O— or —CO— units, Y represents a divalent organic radical, linked through a carbon atom or carbon atoms thereof to the indicated —SH group and —O— or —CO— units, and W represents an organic radical which must contain at least one —SH group when $p$ is 1, linked through a carbon atom or carbon atoms thereof to the indicated —O— or —CO— units.

14. A process according to claim 13, wherein the polythiol is substantially one of the formulae $$R^{13}\left[O-CO-R^{11}-CO-O-R^{15}SH\right]_s$$

$$R^{13}\left[CO-O-R^{12}O-CO-R^{16}SH\right]_s$$

$$R^{13}\left[O\left[CO-R^{11}-CO-O-R^{12}-O\right]_TCO-R^{16}SH\right]_s$$

$$R^{13}\left[CO\left[O-R^{12}-O-CO-R^{11}CO\right]_TO-R^{15}SH\right]_s$$

$$R^{13}\left[O\left[CO-R^{11}-CO-O-R^{12}-O\right]_TCO-R^{11}COO-R^{15}SH\right]_s$$

$$R^{13}\left[CO\left[O-R^{12}-O-CO-R^{11}-CO\right]_TO-R^{12}OCO-R^{16}SH\right]_s$$

$$H\left[O-R^{12}-O-CO-R^{14}-CO\right]_s OR^{12}OH$$

$$HSR^{16}-CO-O-R^{12}-O\left[COR^{14}COOR^{12}O\right]_TCOR^{16}SH$$

wherein $R^{11}$ represents the radical of an aliphatic, cycloaliphatic, or aromatic dicarboxylic acid after removal of the two —COOH groups, $R^{12}$ represents the radical of an aliphatic, araliphatic, or cycloaliphatic diol after removal of the two hydroxy groups, $R^{13}$ represents an organic radical containing at least two carbon atoms and directly linked through carbon atoms thereof to the indicated mercaptan-terminated ester chains, $R^{14}$ represents the radical of an aliphatic, cycloaliphatic, or aromatic dicarboxylic acid containing a mercaptan group, after removal of the —COOH groups, T is an integer of at least 1, s is an integer of at least 2, $R^{15}SH$ denotes the radical of a monomercaptanmonohydric alcohol after the removal of an alcoholic hydroxyl group, and $R^{16}SH$ denotes the radical of a monomercaptanmonocarboxylic acid after the removal of a carboxyl group.

15. A process according to claim 14, wherein the polythiol is substantially one of the formulae $$R^{13}\text{-}[OCO-R^{11}-CO-O-C_mH_{2m}SH]_s$$
$$R^{13}\text{-}[CO-O-R^{12}-O-CO-C_jH_{2j}SH]_s$$
$$R^{13}\text{-}[O\text{-}[CO-R^{11}-CO-O-R^{12}-O]_t CO-C_jH_{2j}SH]_s$$
$$R^{13}\text{-}[O\text{-}[CO-R^{11}-CO-O-R^{12}-O]_t CO-R^{11}-COOC_mH_{2m}SH]_s$$
$$R^{13}\text{-}[CO\text{-}[O-R^{12}-O-CO-R^{11}CO]_t OC_mH_{2m}SH]_s$$
$$R^{13}\text{-}[CO\text{-}[O-R^{12}-O-CO-R^{11}-CO]_t O-R^{12}-O-COC_jH_{2j}SH]_s$$
$$H\text{-}\left[O-R^{12}-O-CO-CH_2\underset{\underset{SH}{|}}{C}HCO\right]_s OR^{12}OH$$
$$HS-C_jH_{2j}-CO-O-R^{12}-O\left[CO-CH_2\underset{\underset{SH}{|}}{C}HCO-O-R^{12}O\right]_t CO-C_jH_{2j}SH$$

wherein $R^{11}$ represents the radical of an aliphatic, cycloaliphatic, or aromatic dicarboxylic acid after removal of the two —COOH groups, $R^{12}$ represents the radical of an aliphatic, araliphatic, or cycloaliphatic diol after removal of two hydroxyl groups, $R^{13}$ represents an organic radical containing at least two carbon atoms and directly linked through carbon atoms thereof to the indicated mercaptan-terminated ester chains, $s$ is an integer of at least 2, $t$ is an integer of at least 1, $j$ is 1 or 2 and $m$ is 2 or 3.

16. A process according to claim 14, wherein $R^{11}$ represents (a) a saturated aliphatic hydrocarbon group of 2 to 10 carbon atoms, which may bear an —SH group, (b) a cycloaliphatic-aliphatic hydrocarbon group of 5 to 34 carbon atoms, which may contain ethylenic unsaturated, or (c) a mononuclear arylene hydrocarbon group of 6 to 12 carbon atoms.

17. A process according to claim 14, wherein $R^{12}$ represents a saturated aliphatic hydrocarbon chain of 2 to 250 carbon atoms, which may be substituted by methyl groups and by —SH groups, and which may be interrupted by ether oxygen atoms and by carbonyloxy groups.

18. A process according to claim 14, wherein $R^{13}$ represents, when directly attached to an —O— unit, a saturated aliphatic hydrocarbon chain of 2 to 250 carbon atoms, which may be substituted by methyl groups and by —SH groups, and which may be interrupted by ether oxygen atoms and by carbonyloxy groups, and, when directly attached to a —CO— unit, (a) a saturated aliphatic hydrocarbon group fo 2 to 10 carbon atoms, which may bear an —SH group, (b) a cycloaliphaticaliphatic hydrocarbon group of 5 to 51 carbon atoms, which may contain ethylenic unsaturated, or (c) a mononuclear arylene hydrocarbon group of 6 to 12 carbon atoms.

19. Process according to claim 1, in which the polymercaptan is:

the tris(thioglycollate) of polyoxypropylenetriols of average molecular weight 600 to 4000, of a glycerol-propylene oxide adduct tipped with ethylene oxide and of average molecular weight 5000, of a hexane-1,2,6-triol-propylene oxide adduct of average molecular weight 1500, of a 1,1,1-trimethylolpropane-propylene oxide adduct of average molecular weight 4040; the bis(thioglucollate) of an adduct, of average molecular weight 1000, of butane-1,4-diol and tetrahydrofuran or of a polyoxypropylenetriol of average molecular weight 4000; the tetrathioglycollate of an adduct, of average molecular weight 4000, pentaerythritol with propylene oxide or of an adduct, of average molecular weight 500, of ethylenediamine with propylene oxide; the tris-(2-mercaptopropionate) of a polyoxypropylenetriol of average molecular weight 4000; a poly(2-hydroxy-3-mercaptopropyl) ether of a polyoxypropylenetriol of average molecular weight of 4800; a polyester comprising units of mercaptosuccinic acid and either butane-1,4-diol or a polyoxypropylene glycol; a polyester comprising units of thioglycollic acid with, as the alcohol component, a polyoxyethylene glycol, polyoxypropylene glycol, butane-1,4-diol or diprimary alcohols prepared by catalytic hydrogenation of methyl esters of aromatic-aliphatic fatty acids and, as the acid component, trimerised linoleic acid or mercaptosuccinic acid; a polyester comprising units of 2-mercaptoethanol with, as the alcohol component, a penterythritol-propylene oxide tetrol adduct or a polyoxypropylenetriol, and, as the acid component, adipic acid, succinic acid, or a dimerised linoleic acid; 3-mercaptopropionic acid with butane-1,4-diol and a trimerised linoleic acid; thioglycollic acid or 3-mercaptopropionic acid with two alcohols chosen from glycerol, butane-1,4-diol, hexane-1, 6-diol, hexane-1,2,6-triol, polyoxypropylenetriols, polyoxypropylene glycol, 1,1,1-trimethylolpropane, mixed diprimary alcohols prepared by catalytic hydrogenation of methyl esters of aromatic-aliphatic fatty acids, 2,2-bis(p-hydroxypropoxyphenyl)propane, and one acid chosen from adipic acid, dimerised linoleic acid, phthalic acid, or succinic acid; a polyester comprising units of a polyoxypropylenetriol with mercaptosuccinic acid, terminated with n-pentanol; or a polyester comprising units of a polyoxypropylene glycol, mercaptosuccinic acid, and adipic acid, terminated with acetic acid.

20. A process according to claim 19, wherein the polythiol is a tris-(thioglycolate) of a glycerol-propylene oxide adduct with an average molecular weight of 4000.

21. A process according to claim 1, wherein the component

2. is a nitrogen-containing condensation product of $d_1$. and epoxide derived from a bisphenol, $e_1$. a fatty amine of the formula $$H_3C(CH_2)_xNH_2,$$

in which $x$ is an integer from 11 to 23 and $f_1$. a dicarboxylic acid of the formula $$HOOC\text{-}(CH_2)_y\text{-}COOH,$$

in which $y$ is an integer from 5 to 12

22. A process according to claim 21, wherein the component $d_1$) is a polyglycidyl ether of 2,2-bis-(4'-hydroxyphenyl)-propane.

23. A process according to claim 21, wherein the component $d_1$) has an epoxide content of at least 5 epoxide equivalent per kg.

24. A process according to claim 21, wherein the component $d_1$) is a reaction product of 2,2-bis-(4'-hydroxyphenyl)-propane and epichlorohydrin.

25. A process according to claim 21, wherein the component $e_1$) is a fatty amine of the formula $$H_3C(CH_2)_{x_1}NH_2$$

in which $x_1$ is an integer from 17 to 21.

26. A process according to claim 21, wherein the component $f_1$) is a dicarboxylic acid of the formula $$HOOC(CH_2)_{y_1}COOH$$

in which $y_1$ is an integer from 6 to 10.

27. A process according to claim 1, wherein there is used 0.5 to 5% of polythiol resin, and 0.1 to 1% of nitrogen-containing condensation product.

28. A process according to claim 1, wherein the components (1) to (3) are applied from organic solutions or from an aqueous medium by the padding method at temperatures of 20° C to 80° C.

29. A process according to claim 1, wherein the keratinous material is treated with the components (1) to (3) at pH values of 6 to 12.

30. A process according to claim 1, wherein the impregnated material is dried at temperatures of 70° C to 150° C.

31. A process according to claim 1, wherein the nitrogen-containing condensation products are further reacted with at least one of the components selected from the group consisting of g. aliphatic diols,
h. aminoplast precondensates containing alkyl ether groups, and
i. epihalogenhydrins.

32. A process according to claim 1, wherein the organic solutions or aqueous emulsions contain in addition to components (1) and (2), as component (3) stabilizers against the harmful action of light.

33. A process according to claim 2, wherein the nitrogen-containing condensation products are further reacted with at least one of the components selected from the group consisting of g. an aliphatic diol with 2 to 22 carbon atoms,
h. an aminoplast precondensate containing alkyl ether groups, and
i. an epihalohydrin.

34. A process according to claim 2, wherein the organic solutions or aqueous emulsions contain in addition to components (1) and (2), as component (3) stabilizers against the harmful action of light, which are phenols with at least one sterically hindered hydroxyl group.

35. A process according to claim 31, wherein the component g) is an aliphatic diol with 2 to 6 carbon atoms.

36. A process according to claim 31, wherein the component (g) is an alkylene diol with 2 to 6 carbon atoms or is diethylene or triethylene glycol.

37. A process according to claim 31, wherein the component (h) is an alkyl ether of almost completely methylolated urea or urea derivatives or melamines, the ether alkyl radicals containing from 1 to 4 carbon atoms.

38. A process according to claim 31, wherein the component h) is a n-butyl ether of a methylolated malamine and contains 2 to 3 n-butyl radicals in the molecule.

39. A process according to claim 34, wherein the stabilisers have the formula

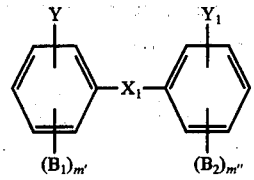

wherein $B_1$ and $B_2$ represent alkyl or alkoxy with 1 to 8 carbon atoms, $X_1$ represents alkylene with 1 to 4 carbon atoms, —CO—, —S— or —O—, Y and $Y_1$ represent hydrogen, hydroxyl or carboxyl, at least one of the substituents being hydroxyl, and m' and m'' are integers from 1 to 4.

40. A process according to claim 34, wherein the stabilisers have the formula

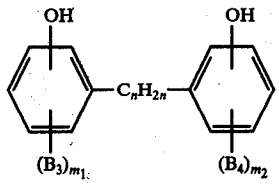

wherein $B_3$ and $B_4$ each independently represents alkyl with 1 to 6, and $m_1$ and $m_2$ are integers of 1 or 2 and $n$ is an integer from 1 to 4.

41. A process according to claim 34, wherein the stabilisers have the formula

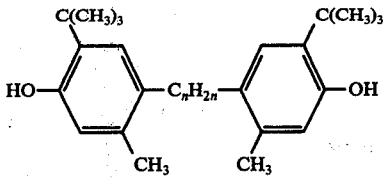

wherein $n$ is an integer from 1 to 4.

42. A process according to claim 34, wherein the stabilisers have the formula

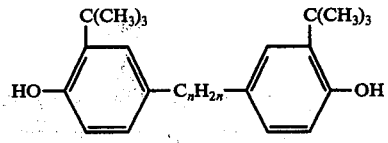

wherein $n$ is an integer from 1 to 4.

43. A process according to claim 34, wherein the stabilisers have the formula

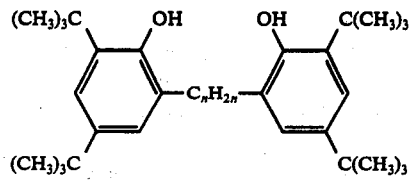

wherein $n$ is an integer from 1 to 4.

44. A process according to claim 34, wherein the stabilisers have the formulae

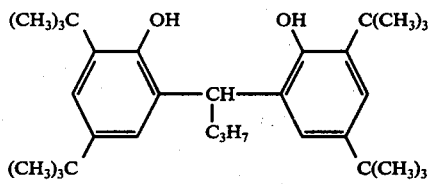

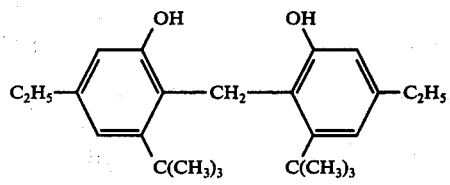

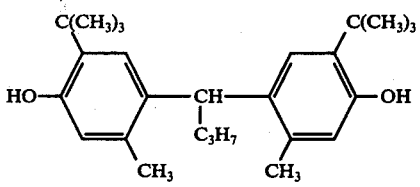

and

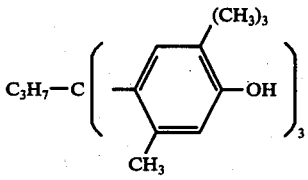

45. A process according to claim 34, wherein the stabilisers have the formula

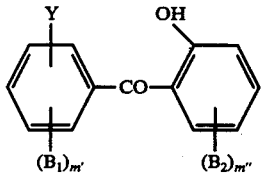

wherein $B_1$ and $B_2$ represent alkyl or alkoxy with 1 to 8 carbon atoms, Y represents hydrogen, hydroxyl or carbonyl and $m'$ and $m''$ are integers from 1 to 4.

46. A process according to claim 34, wherein the stabilisers have the formula

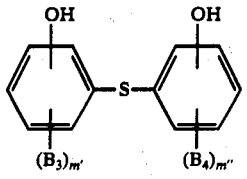

wherein $B_3$ and $B_4$ represent alkyl with 1 to 6, and $m'$ and $m''$ are integers from 1 to 4.

47. A process according to claim 34, wherein the stabilisers have the formula

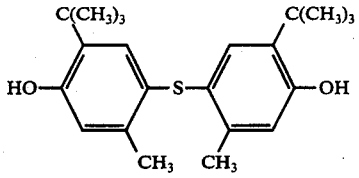

48. A process according to claim 34, wherein the stabilisers have the formulae

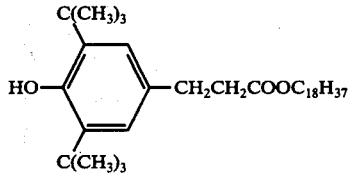

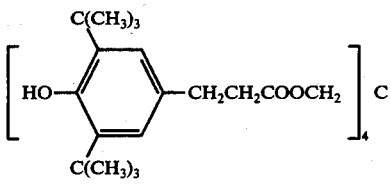

49. A process according to claim 31, wherein the material is padded with organic solutions or aqueous emulsions which contain 1. a tris-(thioglycolate) of a glycerol-propylene oxide adduct with an average molecular weight of 4000 and
2. a nitrogen-containing condensation product obtained from at least d. a reaction product of 2,2-bis-(4'-hydroxyphenyl)-propane and epichlorohydrin,
e. a fatty amine with 20 to 22 carbon atoms,
f. sebacic acid,
g. neopentyl glycol and
i. epichlorohydrin.

50. A process according to claim 49, wherein the material is treated with organic solutions or emulsions which, in addition to the components (1) and (2), contain aminoplast precondensates.

51. A process according to claim 31, wherein the nitrogen-containing condensation product is further reacted with at least one of the components selected from the group consisting of g. an aliphatic diol with 2 to 22 carbon atoms,
h. an aminoplast precondensate containing alkyl ether groups, and
i. epichlorohydrin.

52. A process according to claim 31, wherein the component g) is an aliphatic diol with 2 to 6 carbon atoms and the carbon chains of which are interrupted by oxygen atoms.

53. A process according to claim 32, wherein the stabilizers have the formula

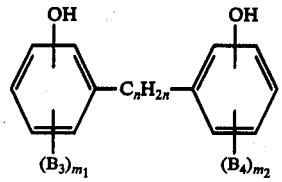

wherein $B_3$ and $B_4$ each independently represents alkyl with 1 to 4 carbon atoms and $m_1$ and $m_2$ are integers of 1 or 2 and $n$ is an integer of 1 to 4.

54. A process according to claim 32, wherein the stabilizers have the formula

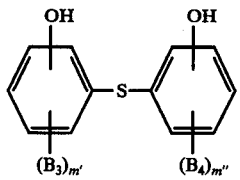

wherein $B_3$ and $B_4$ represent alkyl with 1 to 4 carbon atoms and $m'$ and $m''$ are integers from 1 to 4.

55. A process according to claim 49, wherein the material is treated with organic solutions or emulsions which, in addition to the components (1) and (2), contain aminoplast precondensates and thickeners.

56. A process according to claim 32, wherein there is used 0.5 to 5% of polythiol resin, and 0.1 to 1% of nitrogen-conatining condensation product, and 0.01 to 0.2% of stabilizer, based in each case on the weight of the material.

57. A process according to claim 32, wherein the components (1) to (3) are applied from organic solutions or from an aqueous medium by the padding method at temperatures of 20° C to 40° C.

58. A process according to claim 32, wherein the keratinous material is treated with the components (1) to (3) at pH values of 7.5 to 11.

59. A process according to claim 1, wherein the impregnated material is dried at temperatures of 80° C to 120° C.

60. A process according to claim 1, wherein the impregnated material is dried at temperatures of 80° C to 120° C and in the presence of a catalyst.

61. Preparations for carrying out the process according to claim 1, which contain 1. polythiols with at least two thiol groups in the molecule and having a molecular weight of 400 to 20,000, obtained from
   a. polyalcohols
   b. alkylene oxides and/or dicarboxylic acids and
   $c_1$. carboxylic acids containing thio groups, or from
   $c_2$. epihalohydrins and alkali metal hydrogen sulphides, the polythiols containing ether and/or ester bonds, or from
   $a_1$. polycarboxylic acids
   $b_1$. alkylene oxides or dicalcohols and
   $c_1$. carboxylic acids containing thio groups,
2. nitrogen-containing condensation products of epoxides which contain at least two epoxide groups in the molecule, fatty amines with 12 to 24 carbon atoms, dicarboxylic acids with 1 to 14 carbon atoms, the equivalent ratios of epoxide groups to hydrogen bound to amino nitrogen to carboxylic acid groups being 1:(0.1–1):(1–0.55).

62. Preparations according to claim 61, which contain 1. a polythiol with at least two thiol groups in the molecule and having a molecular weight of 400 to 10,000, of the formula $$\left[R\right]\begin{matrix}[(-\text{O-alkylene})_m-\text{OH}]_{q-1}\\ [(-\text{O-alkylene})_m-\text{O(CO)}_{n-1}-X]_p\end{matrix},$$

wherein $m$ is an integer of at least 1 and may have different values in each of the $p$ and $(q-1)$ chains, $n$ is 1 or 2, $p$ is at least 2, $(p+q)$ equals 3 to 7, each "alkylene" group contains a chain of 2 to 6 carbon atoms between consecutive oxygen atoms, R represents an aliphatic radical containing 20 to 6 carbon atoms, and X represents an aliphatic radical of 1 to 18 carbon atoms, containing at least one thiol group, 2. a nitrogen-containing condensation product of at least
   d. an epoxide which contains at least two epoxide groups in the molecule,
   e. a fatty amine with 12 to 24 carbon atoms, and
   f. an aliphatic saturated dicarboxylic acid with 7 to 14 carbon atoms.

63. Preparations according to claim 61, which contain 1. a tris-(thioglycolate) of a glycerol-propylene oxide adduct with an average molecular weight of 4000 and
2. a nitrogen-containing condensation product obtained from at least
   d. an reaction product of 2,2-bis-(4'-hydroxyphenyl)-propane and epichlorohydrin,
   e. a fatty amine with 20 to 22 carbon atoms,
   f. sebacic acid,
   g. neopentyl glycol and
   i. epichlorohydrin.

64. Preparations according to claim 63, which, in addition to the components (1) and (2), contain an aminoplast precondensate.

65. Preparations according to claim 61, which contain 1. a polythiol resin of the formula

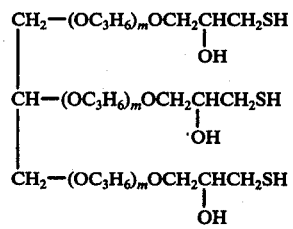

or of the formula

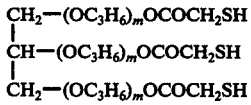

and 2. a nitrogen-containing condensation product of at least
   d. a reaction product of 2,2-bis-(4'-hydroxyphenyl)-propane and epichlorohydrin,
   e. a fatty amine with 20 to 22 carbon atoms,
   f. sebacic acid,
   g. neopentyl glycol, and
   i. epichlorohydrin.

66. A preparation according to claim 61, wherein the nitrogen-containing condensation products are further reacted with at least one of the components selected from the group consisting of
   g. aliphatic diols,
   h. aminoplast precondensates containing alkyl ether groups, and
   i. epihalogenhydrins.

67. A preparation according to claim 61, wherein the organic solutions or aqueous emulsions contain in addition to components (1) and (2), as component (3) stabilizers against the harmful action of light.

68. A process for modifying keratinous material, which comprises treating the material with organic solutions or aqueous emulsions which contain
1. polythiols with at least two thiol groups in the molecule and having a molecular weight of 400 to 20,000 and obtained from
   a. polyalcohols
   b. alkylene oxides and/or dicarboxylic acids and
   $c_1$. carboxylic acids containing thio group, or from
   $c_2$. epihalohydrins and alkali metal hydrogen sulphides,
2. nitrogen-containing condensation products of epoxides, fatty amines, dicarboxylic acids, the equivalent ratios of epoxide groups to hydrogen bound to amino nitrogen to carboxylic acid groups being 1:(0.1–1):(1–0.55), and subsequently drying the treated material.

69. Process according to claim 68, wherein the nitrogen-containing condensation products are further reacted with at least one of the components selected from the group consisting of
   g. aliphatic diols,
   h. aminoplast precondensates containing alkyl ether groups, and
   i. epihalogenhydrins.

70. Process according to claim 68, wherein the organic solutions or aqueous emulsions contain in addition to components (1) and (2), as component (3) stabilizers against the harmful action of light.

71. Preparations for carrying out the process according to claim 68, which contain
1. polythiols with at least two thiol groups in the molecule and having a molecular weight of 400 to 20,000, obtained from
   a. polyalcohols
   b. alkylene oxides and/or dicarboxylic acids and
   $c_1$. carboxylic acids contaning thio groups, or from
   $c_2$. epihalohydrins and alkali metal hydrogen sulphides,
2. nitrogen-containing condensation products of epoxides, fatty amines, dicarboxylic acids, the equivalent ratios of epoxide groups to hydrogen bound to amino nitrogen to carboxylicacid groups being 1:(0.1–1):(1–0.55).

72. A preparation according to claim 71, wherein the nitrogen-containing condensation products are further reacted with at least one of the components selected from the group consisting of
   g. aliphatic diols,
   h. aminoplast precondensates containing alkyl ether groups, and
   i. epihalogenhydrins.

73. A preparation according to claim 71, wherein the organic solutions or aqueous emulsions contain in addition to components (1) and (2), as component (3) stabilizers against the harmful action of light.

74. Preparations according to claim 61, wherein the nitrogen-containing condensation product further contains at least one of the components selected from the group consisting of
   g. an aliphatic diol with 2 to 22 carbon atoms,
   h. an aminoplast precondensate containing alkyl ether groups and
   i. an apichlorohydrin.

75. Preparation according to claim 62, which in addition to components (1) and (2), further contains as component (3) stabilizers of the formula

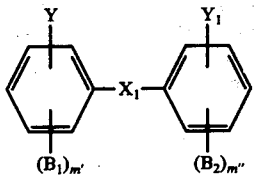

wherein $B_1$ and $B_2$ represent alkyl or alkoxy with 1 to 8 carbon atoms, X represents alkylene with 1 to 4 carbon atoms, —CO—, —S— or —O—, Y and Y' represents hydrogen, hydroxyl or carboxy, at least one of the substituents being hydroxyl, and $m'$ and $m''$ are integers from 1 to 4.

76. Preparations according to claim 51, which, in addition to the components (1) and (2), contain an aminoplast precondensate and a thickener.

77. The keratinous material treated by the process according to claim 1.

* * * * *

UNITED STATES PATENT AND TRADEMARK OFFICE

CERTIFICATE OF CORRECTION

PATENT NO. : 4,066,392

DATED : January 3, 1978

INVENTOR(S) : Heinz Reinach Abel, and Rosemarie Dbrnach Topel

It is certified that error appears in the above-identified patent and that said Letters Patent are hereby corrected as shown below:

Claim 14, column 30, line 54 delete "hydroxy" and insert

--hydroxyl--.

Claim 38, column 34, line 5 delete "malmine" and insert

--melamine--.

Claim 62, column 38, line 20 delete "20" and insert

--2--.

Signed and Sealed this

*Twenty-fifth* Day of *September 1979*

[SEAL]

*Attest:*

*Attesting Officer*

LUTRELLE F. PARKER

*Acting Commissioner of Patents and Trademarks*